US006467888B2

(12) United States Patent
Wheeler et al.

(10) Patent No.: US 6,467,888 B2
(45) Date of Patent: Oct. 22, 2002

(54) INTELLIGENT FLUID DELIVERY SYSTEM FOR A FLUID JET PRINTING SYSTEM

(75) Inventors: David M. Wheeler, New Milford, CT (US); Donald Barker, Sandy Hook, CT (US); Damian Bianchi, Durham, CT (US); Jeffrey W. Jolie, Deep River, CT (US); Jeffrey G. Cartin, New Milford, CT (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/790,166

(22) Filed: Feb. 21, 2001

(65) Prior Publication Data

US 2002/0113850 A1 Aug. 22, 2002

(51) Int. Cl.[7] ..... B41J 2/175
(52) U.S. Cl. ..... 347/85
(58) Field of Search ..... 347/85, 86, 87, 347/50, 19, 7; 358/1.15

(56) References Cited

U.S. PATENT DOCUMENTS

| | | | | |
|---|---|---|---|---|
| 4,901,093 | A | 2/1990 | Ruggiero et al. | 347/70 |
| 4,961,088 | A | 10/1990 | Gilliland et al. | 399/25 |
| 5,021,828 | A | 6/1991 | Yamaguchi et al. | 399/24 |
| 5,049,989 | A | 9/1991 | Arthur et al. | 347/19 |
| 5,132,729 | A | 7/1992 | Matsushita et al. | 399/24 |
| 5,138,344 | A | 8/1992 | Ujita | 347/86 |
| 5,184,181 | A | 2/1993 | Kurando et al. | 399/262 |
| 5,206,668 | A | 4/1993 | Lo et al. | 347/6 |
| 5,265,315 | A | 11/1993 | Hoisington et al. | 29/25.35 |
| 5,283,613 | A | 2/1994 | Midgley, Sr. | 399/9 |
| 5,315,316 | A | 5/1994 | Khormaee | 347/3 |
| 5,365,312 | A | 11/1994 | Hillmann et al. | 399/12 |
| 5,410,641 | A | 4/1995 | Wakabayashi et al. | 358/1.13 |
| 5,414,452 | A | 5/1995 | Accatino et al. | 347/7 |

(List continued on next page.)

FOREIGN PATENT DOCUMENTS

| | | |
|---|---|---|
| DE | 3405 164 | 8/1985 |

*Primary Examiner*—Michael Nghiem
(74) *Attorney, Agent, or Firm*—Lisa M. Soltis; Mark W. Croll; Donald J. Breh

(57) ABSTRACT

An intelligent fluid delivery system and method for controlling fluid delivery and monitoring parameters of fluid usage in a fluid jet printing system. The intelligent fluid delivery system (IFDS) includes the controls and electronic of the base station and fluid bottle. The replaceable base station, or nest, includes a micro-controller, independent of the main controller of the main printing system, for controlling fluid delivery and fluid management. The intelligent fluid delivery system provides a detection mechanism so that it can be ascertained with near certainty that an inserted fluid bottle is an appropriate fluid bottle having a fluid media that is compatible with the fluid jet printing system (e.g., within the specifications of the printing system and suitable for use with the other components of the ink jet printing system). The micro-controller of the intelligent fluid delivery system may be programmed to record and store information relating to the fluid bottle and the fluid media that may be useful when servicing the printing system. The intelligent fluid delivery system also improves the reliability of fluid delivery and fluid management, and hence, the overall performance of the fluid jet printing system by preventing/reducing the use of unknown or non-compatible fluid media. The intelligent fluid delivery system provides an improved fluid delivery system with controlled metering of fluid media, recording capability for the fluid delivery function(s), wireless communication of information between the base station and the fluid bottle, and can also provide communication of status and other information between the base station micro-controller and the main printing system (e.g., OEM provided) controller.

35 Claims, 18 Drawing Sheets

U.S. PATENT DOCUMENTS

| | | | | |
|---|---|---|---|---|
| 5,428,376 | A | 6/1995 | Wade et al. | 347/14 |
| 5,488,223 | A | 1/1996 | Austin et al. | 235/375 |
| 5,491,540 | A | 2/1996 | Hirst | 399/12 |
| 5,506,611 | A | 4/1996 | Ujita, et al. | 347/86 |
| 5,572,292 | A | 11/1996 | Chatani et al. | 399/25 |
| 5,589,859 | A | 12/1996 | Schantz | 347/19 |
| 5,610,635 | A | 3/1997 | Murray et al. | 347/7 |
| 5,627,572 | A | 5/1997 | Harrington, III et al. | 347/23 |
| 5,646,660 | A | 7/1997 | Murray | 347/59 |
| 5,691,750 | A | 11/1997 | Edwards | 347/7 |
| 5,694,156 | A | 12/1997 | Hoisington et al. | 347/7 |
| 5,699,090 | A | 12/1997 | Wade et al. | 347/7 |
| 5,699,091 | A | 12/1997 | Bullock et al. | 347/19 |
| RE35,751 | E | 3/1998 | Midgley | 399/25 |
| 5,760,797 | A | 6/1998 | Koizumi et al. | 347/14 |
| 5,768,140 | A | 6/1998 | Swartz et al. | 700/225 |
| 5,771,051 | A | 6/1998 | Guenther et al. | 347/19 |
| 5,786,828 | A | 7/1998 | Yamamoto | 347/19 |
| 5,788,388 | A | 8/1998 | Cowger et al. | 400/703 |
| 5,797,061 | A | 8/1998 | Overall et al. | 399/27 |
| 5,802,420 | A | 9/1998 | Garr et al. | 399/27 |
| 5,812,156 | A | 9/1998 | Bullock et al. | 347/19 |
| 5,818,475 | A | 10/1998 | Miyazaki et al. | 347/19 |
| 5,835,817 | A | 11/1998 | Bullock et al. | 399/25 |
| 5,860,363 | A | 1/1999 | Childers et al. | 101/483 |
| 5,923,917 | A | 7/1999 | Sakurai et al. | 399/27 |
| 5,926,666 | A | 7/1999 | Miura et al. | 399/25 |
| 5,930,553 | A | 7/1999 | Hirst et al. | 399/8 |
| 5,949,447 | A | 9/1999 | Arai et al. | 347/23 |
| 5,956,057 | A | 9/1999 | Childers et al. | 347/49 |
| 5,959,057 | A | 9/1999 | Furukawa et al. | 528/26 |
| 5,963,759 | A | 10/1999 | Kojima et al. | 399/111 |
| 5,966,144 | A | 10/1999 | Edwards | 347/7 |
| 5,975,688 | A | 11/1999 | Kanaya et al. | 347/86 |
| 5,992,975 | A | 11/1999 | Gasvoda et al. | 347/50 |
| 5,995,774 | A | 11/1999 | Applegate et al. | 399/27 |
| 6,000,773 | A | 12/1999 | Murray et al. | 347/7 |
| 6,010,210 | A | 1/2000 | Wilson et al. | 347/85 |
| 6,011,937 | A | 1/2000 | Chaussade et al. | 399/24 |
| 6,015,209 | A | 1/2000 | Barinaga et al. | 347/86 |
| 6,019,449 | A | 2/2000 | Bullock et al. | 347/14 |
| 6,019,461 | A | 2/2000 | Yoshimura et al. | 347/86 |
| 6,032,127 | A | 2/2000 | Schkoinick et al. | 705/23 |
| 6,039,430 | A | 3/2000 | Helterline et al. | 347/19 |
| 6,158,850 | A | 12/2000 | Cook | 347/85 |
| 6,312,106 | B1 * | 11/2001 | Walker | 347/50 |

* cited by examiner

Ink Jet Printing System 25
24
48
Vent
36
Switches
35
LED's
28
42
41

Return
To
Printing System
Exit
25
24
48
Vent
34
Float
46
Filter
59
Out Level Detect
50
44
41
21
Bottle
Transponder
43
57
Hi Level Detect
58
Low Level Detect
32
Solenoid 42
41
Base Station
Transponder
22
50
Bottle
Transponder
21
57
Hi Level Detect
58
Low Level Detect
59
Out Level
Detect
44
43
28

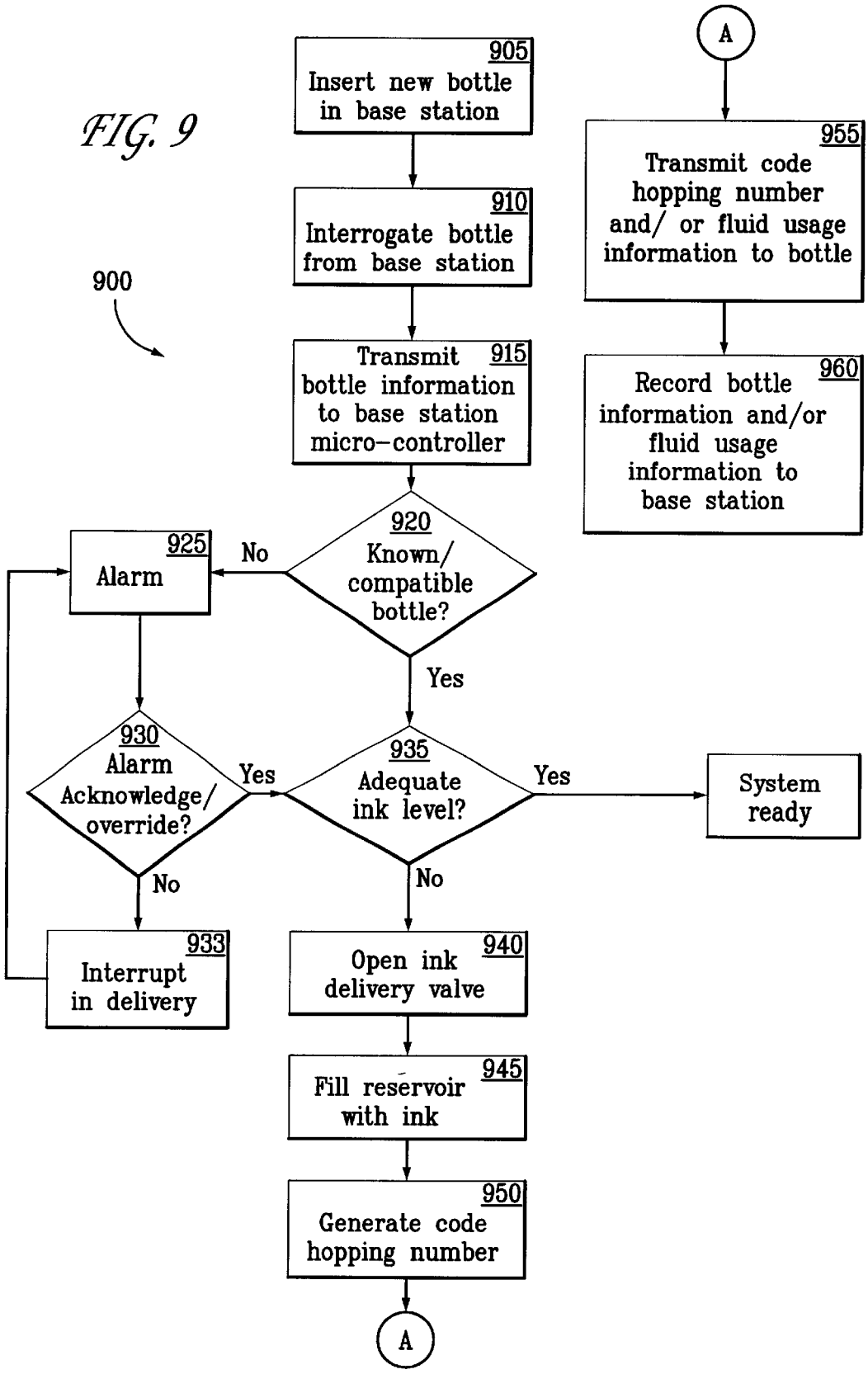
FIG. 9
900
905
Insert new bottle in base station
910
Interrogate bottle from base station
915
Transmit bottle information to base station micro-controller
920
Known/ compatible bottle?
No
Yes
925
Alarm
930
Alarm Acknowledge/ override?
Yes
No
933
Interrupt in delivery
935
Adequate ink level?
Yes
No
System ready
940
Open ink delivery valve
945
Fill reservoir with ink
950
Generate code hopping number
A
A
955
Transmit code hopping number and/ or fluid usage information to bottle
960
Record bottle information and/or fluid usage information to base station

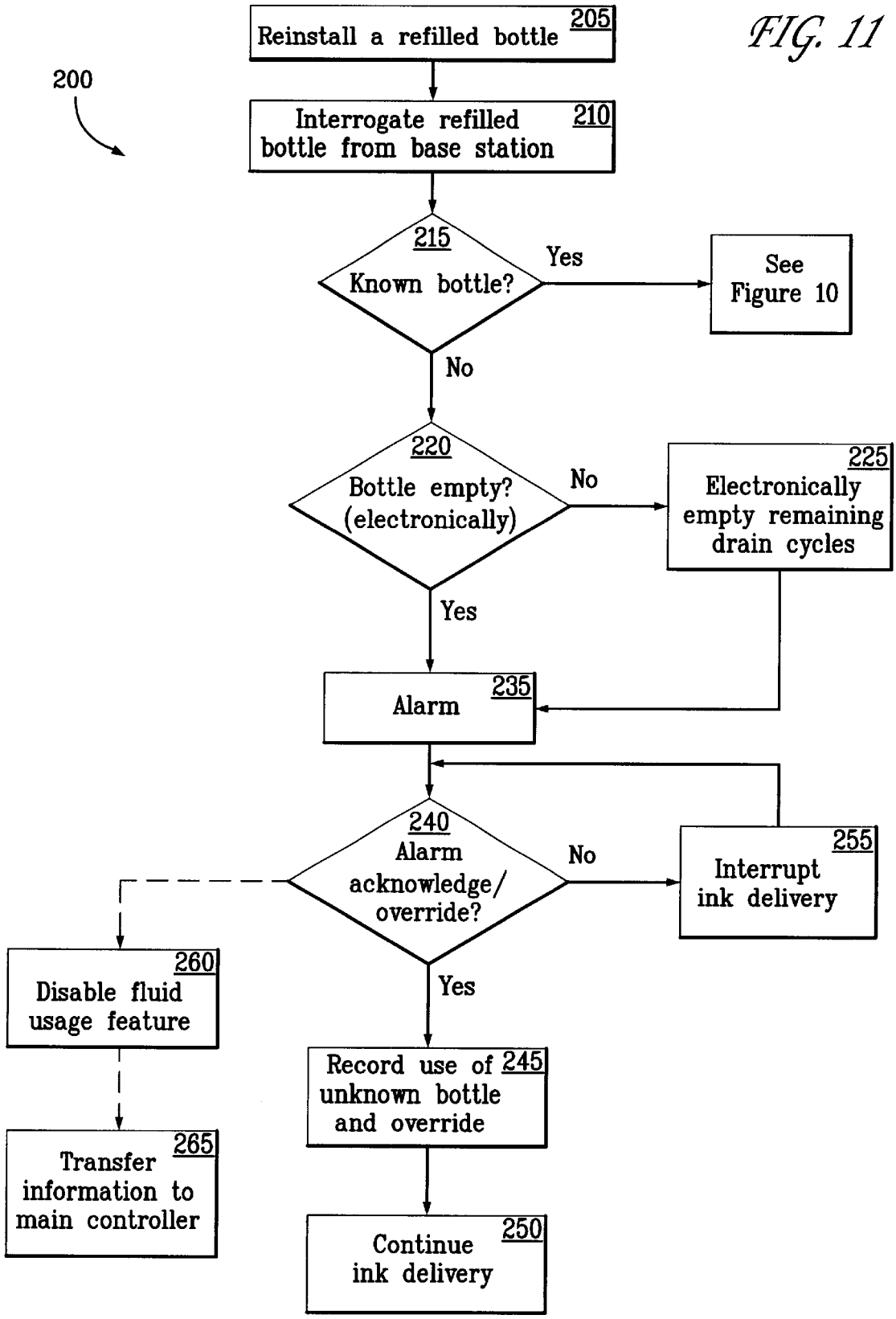
FIG. 11
200
Reinstall a refilled bottle 205
Interrogate refilled bottle from base station 210
215 Known bottle?
Yes
See Figure 10
No
220 Bottle empty? (electronically)
No
225 Electronically empty remaining drain cycles
Yes
Alarm 235
240 Alarm acknowledge/ override?
No
255 Interrupt ink delivery
Yes
260 Disable fluid usage feature
Record use of 245 unknown bottle and override
265 Transfer information to main controller
Continue 250 ink delivery 300
305
Unknown Bottle Used
310
No Signal received from Bottle
315
Operator Override?
No
320
No Action taken by system
Yes
325
Override LED lit
330
Dispense Fluid as needed
335
Record Override to base station along with usage 400
405
Bottle of Expired Ink Inserted
410
Data (incl. expiration date) received from Bottle
415
Warning given – via LED's or OEM controller interface
420
Operator Override to use the ink?
No
425
No Action taken by system
Yes
430
Override LED lit
435
Dispense Fluid as needed
440
Record Override/exp'd ink to base station along with usage

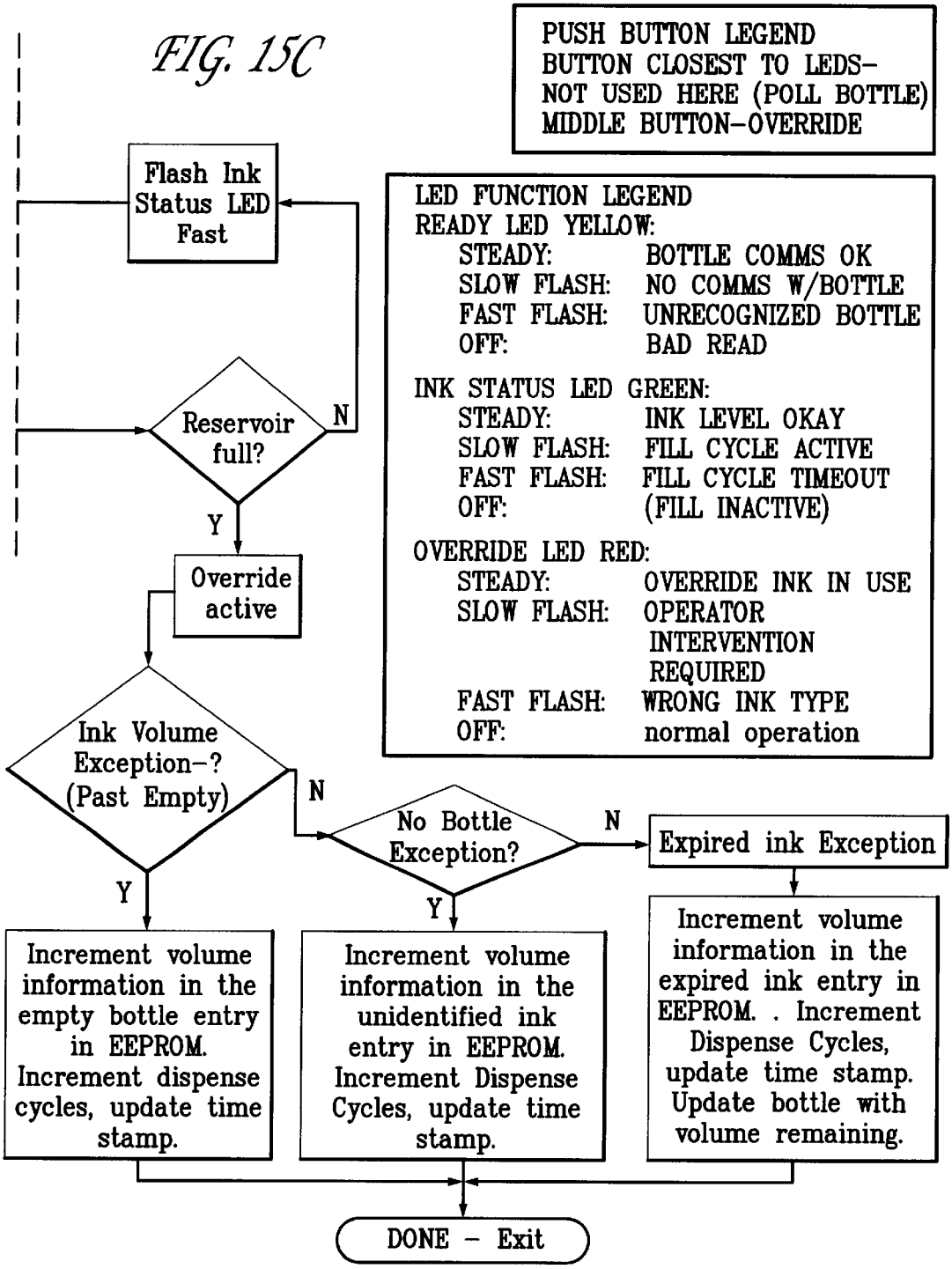
Note: Reservoir Full is defined as either seeing the ink high switch, or a timeout and moving off the low sensor. Reservoir Timeout is when a timeout occurs and the ink low or ink out switch is still made.

INTELLIGENT FLUID DELIVERY SYSTEM FOR A FLUID JET PRINTING SYSTEM

FIELD OF THE INVENTION

The present invention relates in general to dispensing applications, and particularly, to fluid jet printing systems that make use of replaceable printing components having an onboard intelligence for controlling fluid delivery and monitoring the parameters of fluid usage.

BACKGROUND OF THE INVENTION

Fluid jet printers typically make use of fluid jet printheads that move relative to a printing media, such as paper, to deposit a fluid, such as ink, on the printing media. This can be accomplished using different types of fluid jet printers, including, for example, an impulse or drop-on-demand ink jet printer where the printing media moves relative to the printheads, a carriage ink jet printer where the printheads move relative to the printing media, and the like.

In an impulse or drop-on-demand ink jet printer, one or more chambers, including one or more ejection orifices are typically provided. A droplet of ink is ejected from each orifice in response to a contraction of volume in the chamber typically caused by the state of energization of a transducer that may be made, for example, from a piezo-electric material. Ink jet printers employing impulse or drop-on-demand ink jets typically have the same resolution in both the X and Y direction. This resolution permits a wide range of printing, including bar codes as well as alpha-numeric characters. U.S. Pat. No. 4,901,093 entitled "Method and Apparatus For Printing With Ink Jet Chambers Utilizing a Plurality of Orifices" describes a typical drop-on-demand ink jet printer.

Some ink jet printers make use of an ink jet printhead mounted within a carriage that is moved back and forth across a print media, such as paper. In operation of the printing system, the movement of the printhead across the print media is controlled by a main control system that also acts to activate the printhead to deposit or eject ink droplets onto the print media to form images and text. Ink is provided to the printhead by a supply of ink that is either carried by the carriage or mounted to the printing system so that it does not move with the carriage. For the case where the ink supply is not carried with the carriage, the ink supply can be intermittently or continuously connected to the printhead for replenishing the printhead. In either case, the replaceable printing components, such as the ink container and the printhead, require periodic repair and/or replacement. The ink supply is replaced when it is exhausted. The printhead is repaired, as needed, or replaced at the end of the printhead life.

In order to guarantee a reliable printer operation, it is standard to monitor the supply of printing medium in, for example, an ink reservoir. For example, DE-A1-3 405 164 discloses an arrangement for ink printing equipment wherein an ink reservoir is provided for the acceptance of printer ink; the reservoir can comprise an electronic memory means or a coding in which status data of the printer ink relevant to the printer operation are unerasably stored. These data stored in a ROM or as coding (color marking) can be registered trademarks of the manufacture or data about the type of ink employed.

In addition, U.S. Pat. No. 5,365,312, entitled "Arrangement For Printer Equipment For Monitoring Reservoirs That Contain Printing Medium", describes an ink jet printing system having bottles for printing equipment having an electronic memory means in the form of a chip for storing status data of the printing medium relevant to a printing operation. For example, the status data may include information about the current fill status of the bottle and/or other status data, such as the expiration date of the printing medium. The used status of printing medium is acquired via the central controller of the main printing equipment and is communicated to the chip. The chip at the bottle counts consumption until the supply of printing medium (ink fluid, inked ribbon, toner) is exhausted to such an extent that the bottle must be replaced. A reprogramming of the chip and, thus refilling of the bottle is not possible.

Furthermore, ink jet printer equipment continues to be especially sensitive in view of the composition of the ink fluid employed. For example, an ink that is not matched to the ink printing system may lead to a destruction of the printing head. For this reason, it is desirable to prevent used ink reservoirs that are refilled in an uncontrolled fashion, for example by outside manufacturers with ink having an unknown composition, from being reused.

Typically, the data are input once when the ink reservoir is manufactured and are then interrogated upon insertion into the printer. Given lack of coincidence of the data with data stored in a memory, printing may be suppressed.

It is also frequently desirable to alter the parameters of the main printing system concurrently with the replacement of printer components, such as discussed in U.S. Pat. No. 5,699,091 entitled "Replaceable Part With Integral Memory For Usage, Calibration And Other Data". U.S. Pat. No. 5,699,091 discloses the use of a memory device, which contains parameters relating to the replaceable part. The installation of the replaceable part allows the main printer to access the replaceable part parameters to insure high print quality. By incorporating the memory device into the replaceable part and storing replaceable part parameters in the memory device within the replaceable component, the main printing system can determine these parameters upon installation of the replaceable component into the main printing system. This automatic updating of printer parameters frees the user from having to update printer parameters each time a replaceable component is newly installed. The main printer system uses these parameters to control the operation of the printer to ensure high print quality.

U.S. Pat. No. 6,039,430 entitled "Method and Apparatus For Storing and Retrieving Information On a Replaceable Printing Component" describes an ink jet printing system including a replaceable printing component for use in the main printing system. The replaceable printing component includes a memory portion associated therewith for storing information that does not relate directly to normal operation of the printing system. Also included is a main control portion of the printer equipment for providing information to the memory portion associated with the replaceable printing component.

However, these conventional ink jet printing systems lack a stand alone fluid delivery system having an onboard intelligence capable of controlling fluid delivery and monitoring the parameters of fluid usage independently of the main controller and electronics of the main printing system. Also, traditional ink jet printing systems do not have a reliable communication link for transferring information in an ink laden environment. In addition, conventional systems can be unreliable due to failures caused by the introduction of unknown inks into the printing system that may be non-compatible with the other components of the printing system. These conventional systems also lack a means for recording these instances of unknown ink usage that might otherwise be useful in enforcing the provisions of warranty and/or service agreements. Therefore, a need exists for a new intelligent fluid delivery system for controlling fluid delivery and monitoring the parameter of fluid usage in an ink jet printing system.

SUMMARY OF THE INVENTION

The present invention is directed to a fluid jet printing system having an intelligent fluid delivery system for controlling fluid delivery and monitoring the parameters of fluid usage in a fluid jet printing system. The fluid jet printing system includes a stand alone intelligent fluid delivery system having an onboard intelligence capable of controlling fluid delivery and monitoring the parameters of fluid usage independently of the main controller and electronics of the main printing system.

In accordance with another aspect of the invention, the present invention is directed to a system for controlling fluid delivery and the parameters of fluid usage in a fluid jet printing system including a base. station, a fluid bottle, and a communication link between the base station and the fluid bottle. The stand alone base station is removeably mounted to the fluid jet printing system and includes a reservoir in the base station for periodically receiving a replenishment volume of a fluid media from the fluid bottle removeably mounted thereto. The base station also includes a fluid measurement and metering system disposed in the base station for detecting a level of fluid media in the reservoir and for metering and measuring a flow of fluid media flowing from the fluid bottle to the reservoir. A base station transponder module is provided at the base station having a memory and a transponder. A micro-controller in disposed in the base station for controlling fluid delivery and monitoring the parameters of fluid usage. The. functions of controlling fluid delivery and monitoring one or more parameters of fluid usage are controlled by the micro-controller independent from the electronics, controllers, or processors of the main printing system. The fluid jet printing system also includes the fluid bottle that is replaceable mounted to the base station for supplying the replenishment volume of fluid media. The fluid bottle includes a cavity defined by one or more sidewalls of the fluid bottle for holding the fluid media. A bottle transponder module is provided at the fluid bottle having a memory and a transponder. A communication link is established between the base station transponder module and the bottle transponder module when the fluid bottle is inserted in the base station.

The present invention also provides a reliable communication link for transferring information between a fluid bottle and a base station of the intelligent fluid delivery system in an ink laden environment.

In accordance with another aspect of the invention, a wireless communication link is provided for communicating information between the base station and the fluid bottle. In a preferred embodiment, the transducers communicate using radio frequency (RF) techniques. In a more preferred embodiment, the RF techniques further include radio frequency identification (RFID).

The present invention also improves the reliability of the fluid jet printing system and, in particular, the fluid delivery portion of the fluid jet printing system by providing a detection mechanism so that it can be ascertained with near certainty that an inserted fluid bottle is an appropriate fluid bottle having a fluid media that is compatible with the fluid jet printing system (e.g., within the specifications of the printing system and suitable for use with the other components of the ink jet printing system). Preferably, an alarm is activated and fluid delivery is interrupted if an unknown or non-compatible fluid media is detected. Preferably, fluid media delivery is continued when an operator or user acknowledges and overrides the alarm condition. This helps improve the reliability of fluid delivery and fluid management, and hence, the overall performance of the fluid jet printing system by preventing/reducing the use of unknown fluid bottle and/or non-compatible fluid media.

In accordance with another aspect of the invention, the present invention is directed to a base station having a base station transponder module that interrogates a bottle transponder module of a fluid bottle that is installed therein. The bottle transponder module transmits information to the base station transponder module in response to the interrogation that is indicative of whether the fluid bottle is a known fluid bottle and whether the fluid media contained within the fluid bottle is compatible with the fluid jet printing system.

The information transmitted from the bottle transponder module to the base station transponder module is recorded and stored for later use in enforcing, voiding, and/or adjusting one or more of warranty and service agreements if a non-compatible fluid is used in the fluid jet printing system and a failure occurs as a result of using the non-compatible fluid. Preferably, an alarm indication is activated if an unknown bottle and/or a non-compatible fluid media is installed and the flow of replenishment fluid media from the fluid bottle to the reservoir is interrupted if the fluid bottle is not positively identified by the micro-controller. Preferably, the flow of replenishment fluid media from the fluid bottle to the reservoir is only interrupted until a user acknowledges and overrides an alarm indication.

The present invention also includes a means for recording those instances of unknown ink usage that might otherwise be useful in servicing the fluid jet printing system. This recorded information may also be used in enforcing or modifying the provisions of warranty and/or service agreements in those instances where an unknown bottle is used having a non-compatible ink resulting in a failure. The independent micro-controller of the intelligent fluid delivery system may be programmed to record and store information relating to the fluid bottle, the fluid media, and fluid usage that may be useful in reconstructing the events leading up to a failure in the fluid jet printing system.

In accordance with another embodiment of the invention, a method for controlling fluid delivery and monitoring the parameters of fluid usage in a fluid jet printing system including the steps of: providing a base station having a base station transponder module having transponder and memory capabilities; providing a fluid bottle having a bottle transponder module having transponder and memory capabilities; removeably mounting the fluid bottle in fluid communication with the base station; and controlling fluid delivery from the fluid bottle to a reservoir of the base station by controlling one or more of metering the flow of fluid and measuring the flow of fluid from the bottle to the reservoir using a micro-controller disposed in the base station, wherein the micro-controller controls fluid delivery and fluid management independently of a main controller which controls the printing operation of the fluid jet printing system.

In accordance with another aspect of the invention, the method further includes the steps of transferring status and other information relating to fluid delivery and fluid usage from the micro-controller to the main controller via a communications link, wherein the communication link is for the transfer of information only and does not provide any control function to or from the main controller of the main printing system.

In accordance with another aspect of the invention, the method further includes the steps of: interrogating the bottle transponder module using a source signal generated by the base station transponder module; emitting a response signal containing information relating to one or more of the fluid bottle and the fluid media from the bottle transponder module toward the base station transponder module; and controlling a flow of fluid media from the fluid bottle to the base station based the information contained in the response signal emitted from the bottle transponder module.

In accordance with another aspect of the invention, the method further includes the step of storing the information contained in a response signal at the base station. In accordance with another aspect of the invention, the method further includes the steps of enforcing, voiding, and/or adjusting one or more of warranty and service agreements based on the information contained in the response signal recorded at the base station if a failure occurs due to an unknown bottle or non-compatible fluid media.

In accordance with another aspect of the invention, the method further includes the step of establishing a wireless communication link to accomplish the steps of interrogating and emitting. In a preferred embodiment, Radio-Frequency techniques are used to establish the wireless communication link.

The intelligent fluid delivery system of the present invention provides an improved fluid delivery system with controlled metering of fluid media, recording capability for the fluid delivery function(s), wireless communication of information between the base station and the fluid bottle, and can also provide communication of status and other information between the base station micro-controller and the main printing system (e.g., OEM provided) controller.

Other features of the invention are described below.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings embodiments that are presently preferred, it being understood, however, that the invention is not limited to the specific methods and instrumentalities disclosed. In the drawings:

FIG. 9 is a flow chart illustrating the method of installing a fluid bottle in an initial dry ink jet printing system in accordance with the present invention;

FIG. 11 is a flow chart illustrating the method of detecting an unknown fluid bottle that has been mysteriously physically refilled to a full condition with unknown or non-compatible ink in accordance with the present invention;

FIGS. 15, 15A, 15B and 15C are flowcharts illustrating the overall logic of the intelligent fluid delivery system.

DETAILED DESCRIPTION OF THE PREFERRED EMBODIMENTS

Figure 1A:
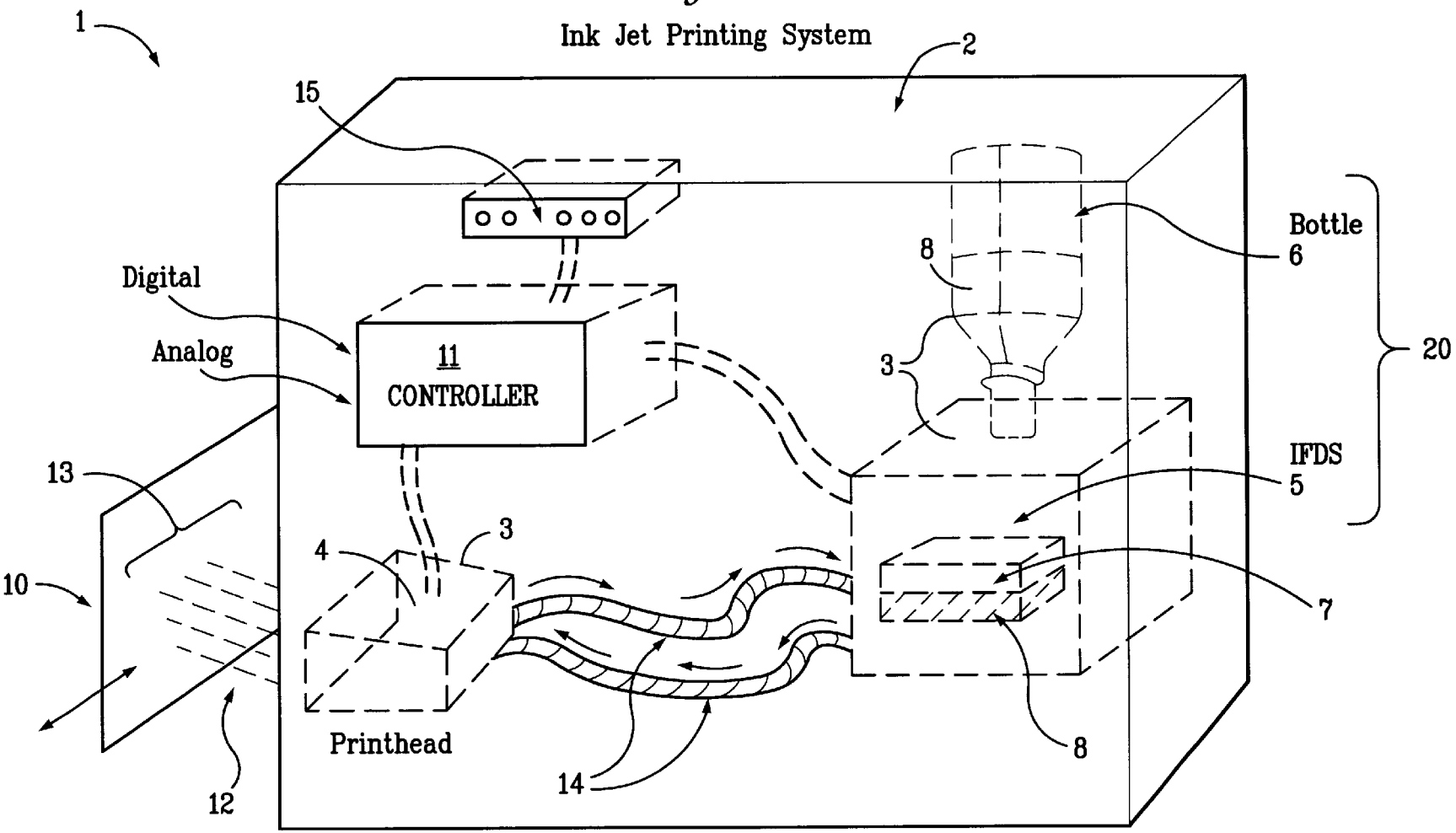
FIG. 1A is a perspective view of an exemplary fluid jet printing system that incorporates the intelligent fluid delivery system in accordance with the present invention.

The present invention is directed to an intelligent fluid delivery system for controlling fluid delivery and monitoring parameters of fluid usage in a fluid jet printing system. Although described with reference to several embodiments wherein the fluid jet printing system is an ink jet printing system, the invention is not so limited.

The intelligent fluid delivery system provides a detection mechanism so that it can be ascertained with near certainty that an inserted fluid bottle is an appropriate fluid bottle having a fluid media that is compatible with the ink jet printing system (e.g., suitable for use with the other components of the ink jet printing system). The intelligent fluid delivery system provides an improved fluid delivery system with controlled metering of fluid media, recording capability for the fluid delivery function(s), communication of information between the base station and the fluid bottle, and communication of status and other information between the base station micro-controller and the main printing system (e.g., OEM provided) controller.

In addition to foreign object discrimination, the intelligent fluid delivery system can identify the type of fluid bottle that is inserted and the characteristics of the fluid media contained therein. This allows the intelligent fluid delivery system to control fluid delivery and preferably set selected fluid delivery parameters thereby optimizing the performance of the fluid delivery system for a particular fluid media.

The intelligent fluid delivery system (IFDS) improves the reliability of fluid delivery and fluid management, and hence, the overall performance of the ink jet printing system. This can be accomplished by preventing/reducing the use of unknown fluid media that is not compatible with the specifications of the printing system by detecting the presence of an unknown or unidentified fluid bottle and providing a nuisance or inconvenience alarm that is activated whenever an unknown fluid bottle is installed into the base station. The alarm notifies the user of an unknown fluid media and allows the user to check the newly inserted fluid bottle to ensure that it is compatible with the printer specifications. This feature deters, but preferably does not prevent, the use of unknown fluid with the main printing system by requiring the user to acknowledge the alarm and consciously decide to proceed with the operation of the ink jet printing system using the unknown fluid bottle. For example, if an unknown fluid bottle that does not have a transponder is installed into the base station, then no communications will be established between the base station and the fluid bottle and therefore the fluid bottle will not be detected. In this case, the user can then activate an override function to let the base station know that a fluid bottle is in fact installed and to commence fluid delivery.

The intelligent fluid delivery system includes the controls and electronics of the base station and fluid bottle. The replaceable base station, or nest, includes a micro-controller for controlling fluid delivery and fluid management. The micro-controller of the intelligent fluid delivery system may be programmed to record and store information, such as information relating to warranty and servicing agreements. This information may be retrieved later in order to enforce, void, and/or adjust these types of agreements. For example, if an unknown fluid bottle is inserted into the base station and non-compatible ink is delivered by the base station to the ink jet printing system, then this information may be recorded by the intelligent fluid delivery system for later use in voiding the warranty of the ink jet printing system if the non-compatible ink causes a failure or damage, such as, for example, failure or damage to the printheads or some other components of the printing system.

FIG. 1A shows a perspective view of an exemplary ink jet printing system 1 having an intelligent fluid delivery system 20. As shown in FIG. 1, the ink jet printing system 1 includes a main printing system 2 having a plurality of replaceable printing components 3 removeably installed therein. The replaceable printing components 3 include one or more printheads 4, a base station 5, and a fluid bottle 6. The base station 5 has a reservoir 7 for providing a fluid media 8 to the printhead(s) 4 and for receiving a replenishment of fluid media 8 from the fluid bottle 6. The base station 5 is removeably mounted to the main printing system 2 and the fluid bottle 6 is removeably mounted to the base station 5.

The main printing system 2 includes one or more ink jet printheads 4 that move relative to a printing media 10, such as paper, to deposit a fluid, such as ink, on the printing media 10. This can be accomplished using different types of fluid jet printers, including, for example, a carriage ink jet printer where the printheads move relative to the printing media (not shown), an impulse or drop-on-demand ink jet printer where the printing media moves relative to the printheads (see FIGS. 1A and 1B), and the like.

Figure 1B:
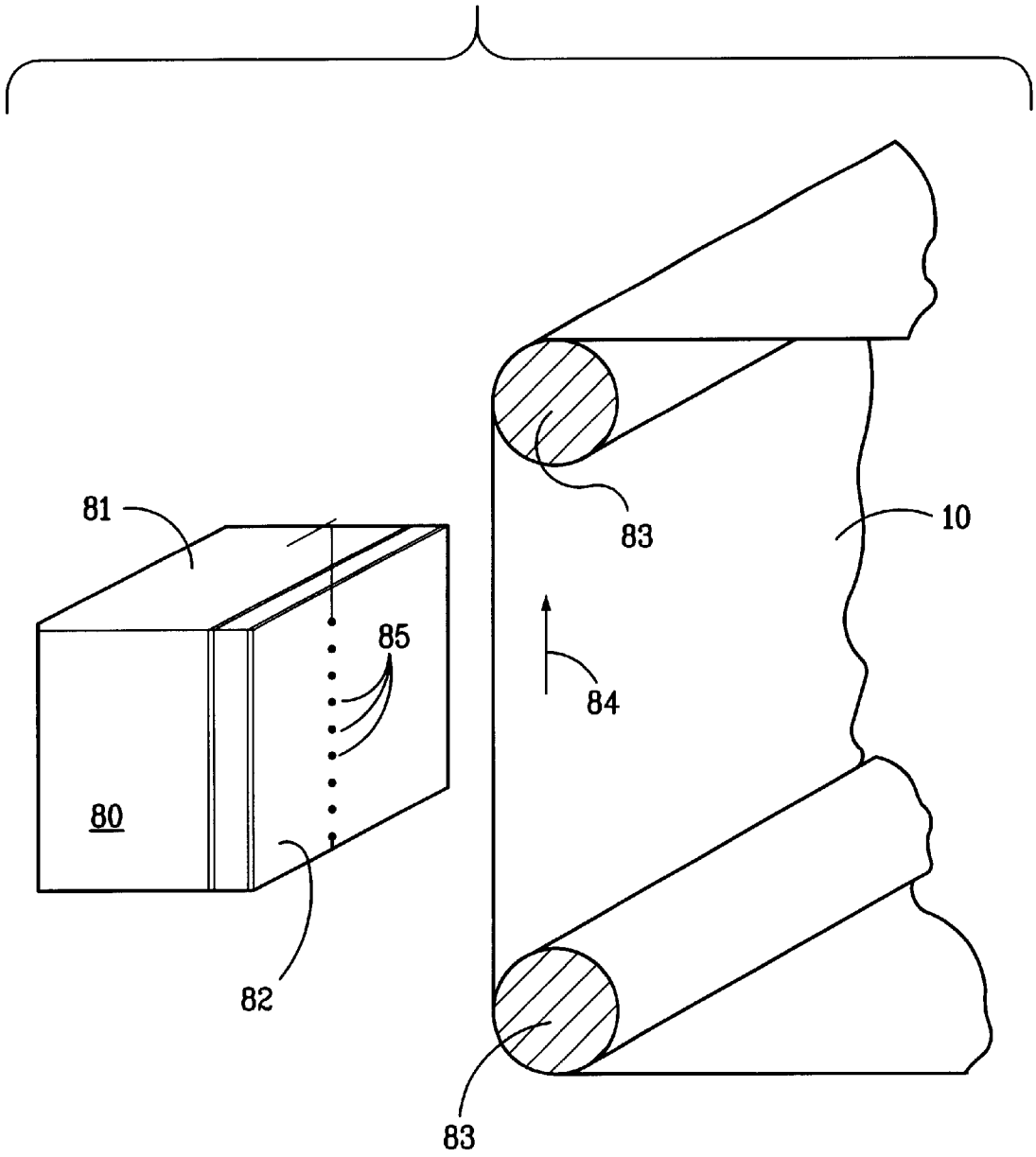
FIG. 1B is a perspective view of an exemplary drop-on-demand fluid jet printing system that can be used with the present invention.

As shown in FIGS. 1A and 1B, the print media 10 can move relative to the printhead 4. The main printing system 2 includes a main controller 11 that controls the printing operation of the ink jet printing system 1. A plurality of associated electronics 15 (e.g., indicators, buttons, keyboard, mouse, display panel, etc.) are provided as part of the main printing system 2 for inputting printing system parameters to the main controller 11, and for controlling and monitoring operation of the main printing system 2. In operation of the ink jet printing system 1, the movement of the print media 10 relative to the printheads 4 is controlled by the main controller 11 of the main printing system 2 that also acts to activate the printheads 4 to deposit or eject ink droplets 12 onto the print media 10 to form images and text as the print media 10 passes through a print zone 13.

As shown in more detail in FIG. 1B, an exemplary drop-on-demand ink jet printhead 80 includes a reservoir 81 and an imaging head 82, which is juxtaposed to a target in the form of paper 10. The paper 10 is advanced by means of mechanism 83 so as to move the paper in increments in the direction indicated by arrow 84. One or more orifices 85 can be linearly arranged, as shown in FIG. 1B, to depositing ink onto the paper 10.

Alternatively, the ink jet printing system 1 can include a carriage type ink jet printer (not shown). In an exemplary carriage type ink jet printer the printheads 4 can be mounted within, for example, a carriage (not shown) that can move back and forth across the print media 10.

Referring back to FIG. 1A, fluid media 8 can be provided to the printheads 4 by a supply of fluid media 8 that is supplied from the reservoir 7 of the base station 5 to the main printing system 2 via, for example, a fluid conduit 14. The fluid supply can be intermittently or continuously connected to the printheads for replenishing the printheads. Likewise, the fluid bottle 6 can intermittently or continuously replenish the supply of fluid media 8 in the base station reservoir 7. In either case, the replaceable printing components 3, such as the printheads 4, the base station 5, and the fluid bottle 6, may require periodic repair and/or replacement. Each printhead 4 is repaired, as needed, or replaced at the end of the printhead life. The base station 5 is replaced at the end of the base station life or to upgrade the logic of the base station micro-controller. The fluid bottle 6 is replaced when it is exhausted.

Figure 2:
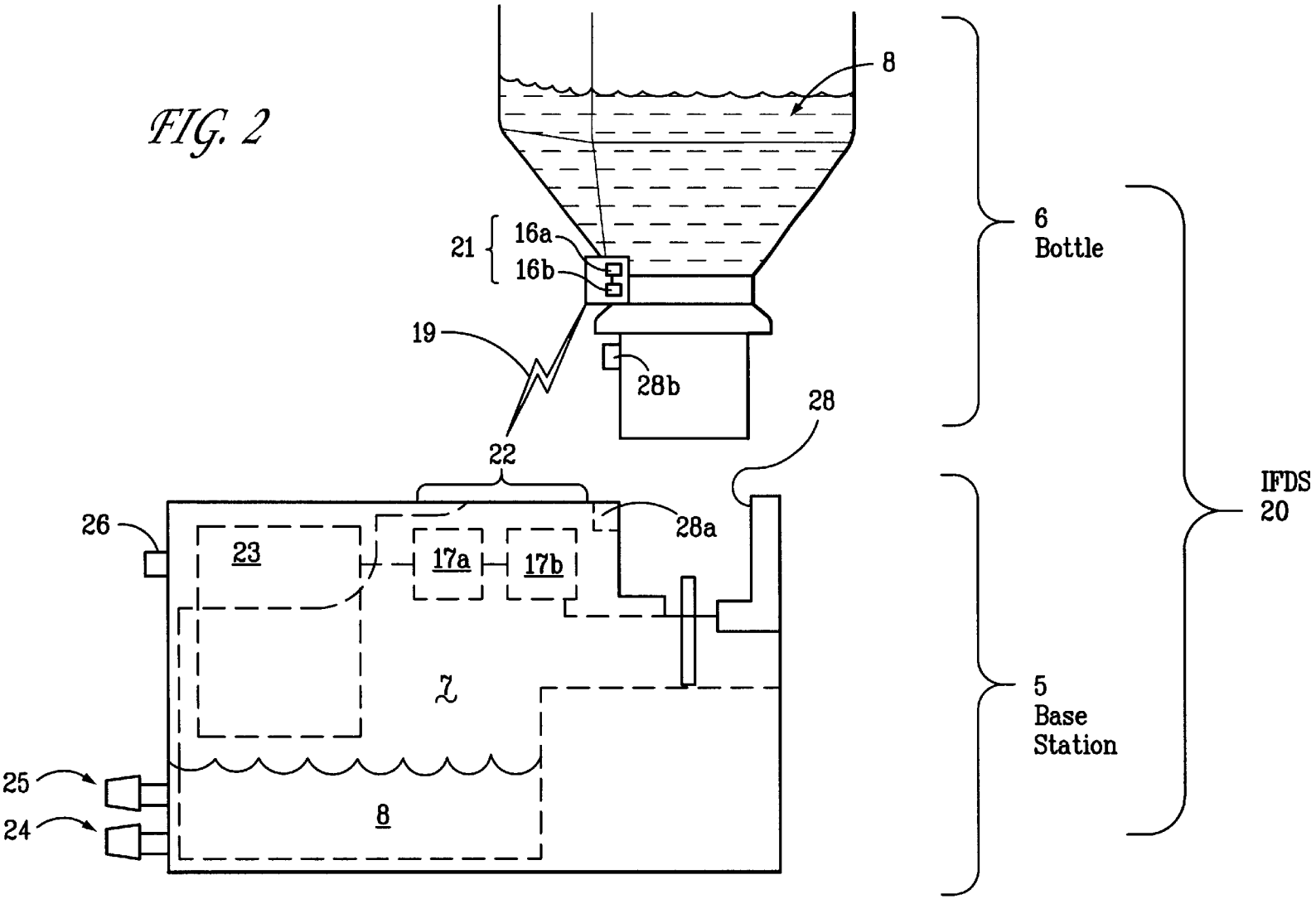
FIG. 2 is an exploded side view of the exemplary intelligent fluid delivery system of FIG. 1.

FIG. 2 shows an exemplary intelligent fluid delivery system 20 including the base station 5 and fluid bottle 6. As shown in FIGS. 1A and 2, the intelligent fluid delivery system 20 is removeably mounted to the main printing system 2. The main printing system 2 is a permanent portion of the ink jet printing system 1 and includes the main controller 11 (e.g., the ink jet printer Original Equipment Manufacturer (OEM) controller) and associated electronics 15 for controlling the printing operations.

The intelligent fluid delivery system 20 includes the fluid bottle 6 for containing the fluid media 8 (e.g., an ink) and the base station, or nest, 5 that houses the reservoir 7 for receiving the fluid media 8 from the fluid bottle 6 and for delivering the fluid media 8 to the main printing system 2. The fluid bottle 6 is provided with a bottle transponder module 21 having memory 16*a* and transponder 16*b* capability. The base station 5 is similarly provided with a base station transponder module 22 having memory 17*a* and transponder 17*b* capability, as well as, a processor or micro-controller 23 for controlling fluid delivery and fluid management. Preferably, the bottle transponder module 21 is programmed by the manufacturer and the bottle memory stores information, such as manufacturer identification code, bottle lot number, fluid type, expiration date or shelf life, quantity, and the like.

When the fluid bottle 6 is properly installed in the base station 5, the bottle and base station transponders 21, 22 align, such that a communication link 19 between the transponders is achieved. Preferably, wireless communication is established between the transponder modules 21, 22, as shown in FIG. 2. Also, two-way communication is preferably achieved between the transponder modules 21, 22. For example, information stored in the bottle memory can be accessed by the base station micro-controller 23 and the accessed information may be stored in the base station memory 17*a,* and a feedback loop can communicate updated information from the micro-controller 23 of the base station 5 to the bottle memory 16*a,* such as, for example, fluid usage information.

The intelligent fluid delivery system 20 may be programmed to record information relating to the fluid bottle and the fluid media contained therein. This recorded information can be used to determine whether the fluid media is compatible with and/or will not damage the material components. of the printing system, such as the printheads, the fluid delivery system, as well as other printer components. For example, if an unknown and/or refilled bottle is installed in the base station 5 and unknown ink is delivered from the base station 5 to the main printing system 2, this information can be recorded by the intelligent fluid delivery system 20. This information may be useful when servicing a printing system that has failed due to non-compatible fluid media. Alternatively, the intelligent fluid delivery system 20 may be programmed to only deliver fluid media 8 to the main printing system 2 if there is communication between the bottle transponder module 21 and base station transponder module 22, and/or if the user acknowledges an alarm indication. In other words, if an unknown or unidentified bottle were installed, the user would have to acknowledge an alarm and consciously decide to continue operating the ink jet printing system 1 with the unknown ink installed.

As further shown in FIG. 2, the base station 5 includes an ink outlet connection 24 and an ink return connection 25 for communicating a flow of ink between the base station 5 and the main printing system 2. The main printing system 2 includes corresponding ink inlet and an ink outlet connections (not shown) corresponding to the ink outlet connection 24 and the ink return connection 25, respectively. The base station 5 also includes a connection 26 for establishing a communication link between the base station 5 and the main controller 11. This may be a hard-wire or wireless connection. The base station 5 also includes a bottle connection 28 for receiving a fluid bottle 6. Preferably, the bottle connection 28 includes an alignment member 28*a,* such as a mechanical stop or key and slot, and the bottle includes a corresponding alignment structure 28*b* for helping to align the bottle transponder module 21 and the base station transponder module 22. The base station is removably mounted to the printing system so that it may be replaced for repairs and/or upgrading of the intelligent fluid delivery system, and therefore, the various connections are preferably quick disconnect-type connections.

Figures 3, 3A:
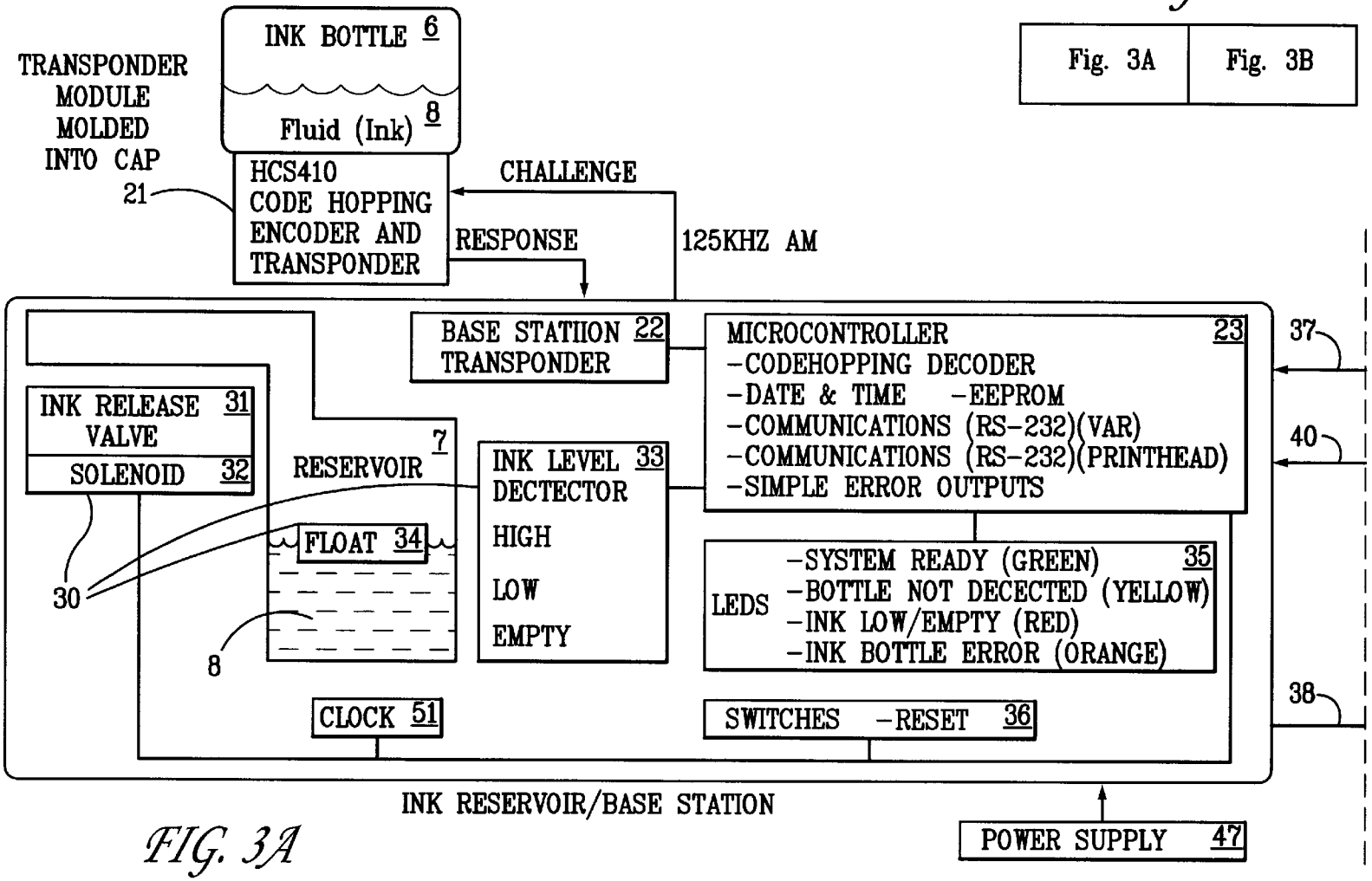
FIG. 3 is a schematic diagram of an exemplary ink jet printing system that incorporates the intelligent fluid delivery system in accordance with the present invention.
Figure 3B:
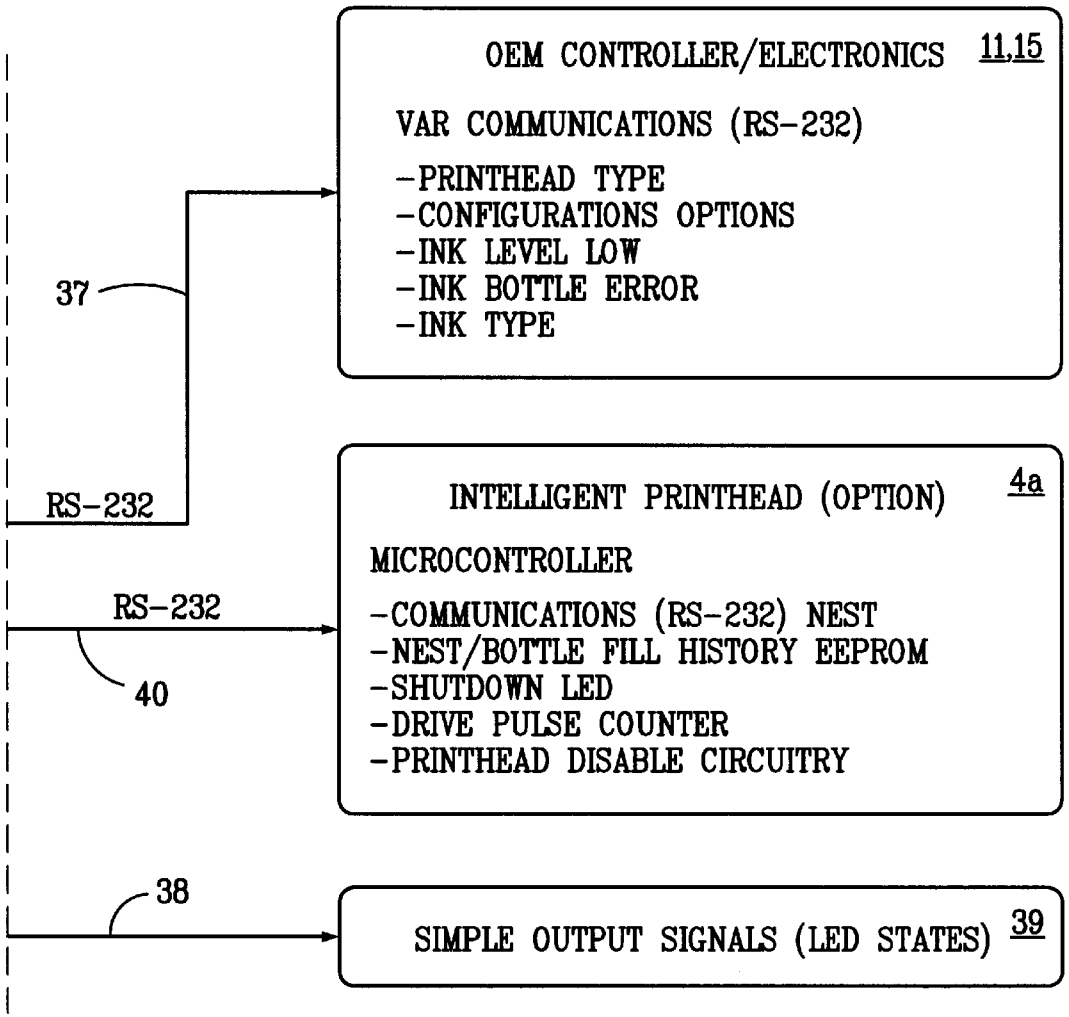

FIG. 3 is a schematic diagram showing the exemplary ink jet printing system 1 of FIG. 2 that incorporates the intelligent fluid delivery system 20 in accordance with the present invention. As shown in FIGS. 2 and 3, the intelligent fluid delivery system 20 includes a replaceable fluid bottle 6 and a replaceable base station 5. The fluid bottle 6 is removeably mounted to the base station 5, and the base station 5 is removeably mounted to the main printing system 2. The fluid bottle 6 has a bottle transponder module 21 and the base station 5 has a corresponding base station transponder module 22 and micro-controller 23 for controlling fluid delivery and fluid management.

As shown in FIG. 3, when a fluid bottle 6 is inserted into the base station 5, the base station transponder module 22 challenges or interrogates the bottle transponder module 21. In response, the bottle transponder module 21 transmits a response to the base station 5, which is received and recorded by the base station transponder module 22. The information contained in the response signal is fed to the base station micro-controller 23, which stores this information for later retrieval. The recorded information can be used to set or adjust the parameters of fluid delivery and fluid management at the base station, to modify the provisions of a warranty or service agreement if a failure occurs as a result of using unknown and non-compatible ink, etc.

The micro-controller 23 also controls and receives data from the fluid measurement and metering system 30. The fluid measurement and metering system 30 is disposed in the base station 5 for detecting a level of fluid media 8 in the reservoir 7 and for metering/measuring a flow of fluid media 8 flowing from the fluid bottle 6 to the reservoir 7. As described more fully below, one embodiment of the fluid measurement and metering system 30 can include a fluid inlet metering system and a float type level detection system. The fluid inlet metering system can include, for example, a fluid delivery valve 31, which can include a solenoid 32 operated valve 31, which is controlled by the micro-controller 23. The float type level detection system preferably includes high, low, and empty set point switches 33. When one of the high, low, or empty set-points is detected by the movement of a float 34 in the reservoir 7, then this data is transmitted to the micro-controller 23 for use in controlling fluid delivery and fluid management. For example, if a high level is detected, then the flow of fluid media 8 from the fluid bottle 6 can be closed off and if a low level were detected, then the flow of fluid media 8 from the bottle can be commenced by the micro-controller 23.

The micro-controller 23 also controls the operation of the various indicators 35 and switches 36 of the base station 5. For example, the micro-controller 23 controls the indicators 35 indicating, for example, system ready, bottle not detected, fluid low/empty, fluid bottle error, and the like. In one embodiment, the indicators 35 can include colored LEDs.

Optionally, the base station 5 may include a connector or communication link 37 for transmitting information between the intelligent fluid delivery system 20 and the main controller 11 of the main printing system 2. This link 37 is for the transfer of information only and does not provide any control function to or from the main controller 11 of the main printing system 2. Preferably, in those embodiments that include a communication link 37 between the micro-controller 23 and the main controller 11, status and other information relating to fluid delivery and fluid usage can be transferred based on a request or query initiated by either the main controller 11 or the base station micro-controller 23. Alternatively, the transfer of information may occur periodically, such as at predefined time intervals or when a change of state occurs in either the intelligent fluid delivery system 20 or the main printing system 2.

Also, the base station 5 may include a connector or communication link 38 that provides for the simple output signal of one or more states of the base station 5, such as the various indicator 35 states described above, to an external display device 39. In addition, the ink jet printing system 1 can include an intelligent printhead option. In an embodiment having an intelligent printhead option, a connector or communication link 40 can be provided for transferring information between the intelligent base station 5 and the intelligent printheads 4*a*.

Figures 4A, 4B, 4C:
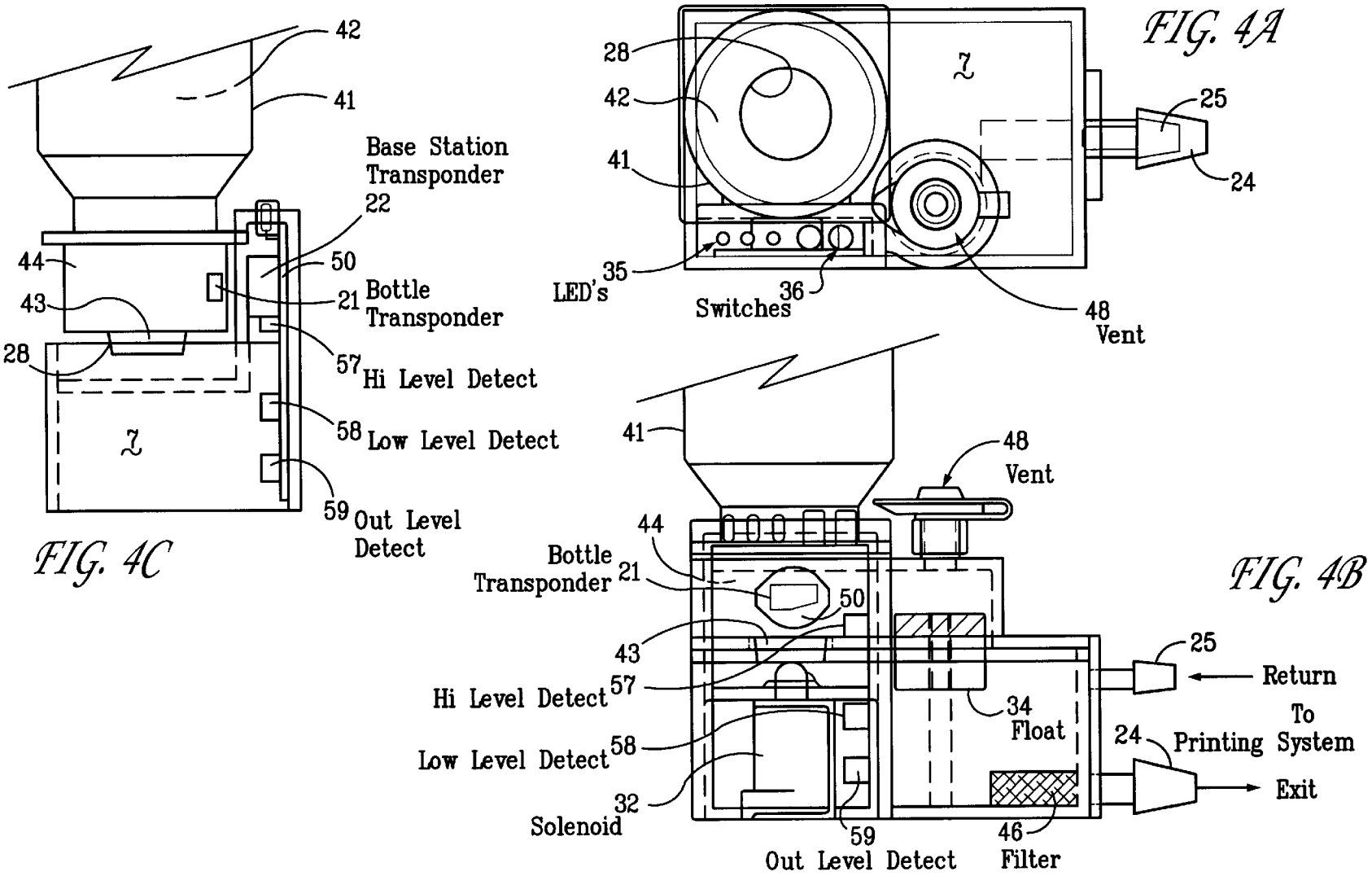
FIG. 4A is a top view of an exemplary mating of a fluid bottle to the base station in accordance with the present invention.
FIG. 4B is a side view of an exemplary mating of a fluid bottle to the base station of FIG. 4A.
FIG. 4C is an end view of an exemplary mating of a fluid bottle to the base station of FIG. 4A.

FIGS. 4A–4C are top, side and end views, respectively of an exemplary intelligent fluid delivery system showing further details of an exemplary base station 5 and fluid bottle 6, and the connection of the fluid bottle 6 to the base station 5. As shown in FIGS. 4A–4C, the fluid bottle 6 has one or more sidewalls 41 defining a cavity 42 for containing a fluid media 8, such as, for example, an ink. The fluid bottle 6 is a replaceable unit that is removeably mounted to the base station 5 so that in an operating condition it is in fluid communication with the reservoir 7 of the base station 5. The fluid bottle 6 includes a neck portion 43 that is inserted into the bottle connection 28 of the base station 5. The fluid bottle 6 may also includes a cap portion 44. The bottle transponder module 21 is attached to the fluid bottle 6.

As shown, the float 34 travels along a rod 45 mounted in the reservoir 7. Alternatively, the float may travel within guides or a cavity (not shown). Preferably, the float 34 is a non-stick float that is allowed to travel with minimum friction between the highest and lowest set point switches. Preferably, a filter 46 is provided at the fluid outlet connection 24.

As shown, the bottle transponder module 21 can be captivated in the bottle cap 44 with its counterpart base station transponder module 22 assembled on a printed circuit board (PCB) 50 that is sealed in the ink reservoir 7 of the base station 5, as shown in FIG. 4B. The base station transponder 22 can be sealed in the base station 5 to prevent tampering with the base station transponder module 22. Alternatively, the bottle transponder module 21 can be disposed within the fluid media 8 in the fluid bottle 6, providing the bottle transponder module 21 includes the proper protection and alignment mechanism (not shown).

Since the transponder modules preferably communicate using radio waves (e.g., 125 KHz AM) they can be isolated from the fluid media 8. As shown in FIGS. 4B and 4C, the bottle transponder module 21 can be molded into the cap 44 of the fluid bottle 6 away from the effects of the ink 8, although other locations on the bottle and different means of attaching the bottle transponder module to the bottle are contemplated depending on the particular application.

Power for the bottle transponder module 21 can be derived from the magnetic field induced by the base station transponder module 22, which can be powered by a power supply 47. The power supply 47 can include an electrical connection to the main printing system 2 or an independent power supply (not shown), such as a battery. As shown in FIG. 3, the base station 5 can include a power supply 47 connected to the base station 5 for supplying electrical power to the micro-controller 23 and associated electronics of the base station 5.

As described above, the base station 5 includes a PCB 50 disposed therein. The PCB 50 that has the base station transponder module 22 mounted thereon can be used to incorporate other base station functions and associated electronics, such as LED indicators 35, switches 36, the fluid measurement and metering components 31, 32, 33, 34, base station interface links 37, 38, 40, and the like.

The base station 5 also includes a micro-controller 23 for controlling fluid delivery and for monitoring the parameters of fluid usage. The micro-controller 23 of the base station 5 enables the intelligent fluid delivery system 20 to be a stand alone and intelligent system for controlling the delivery of fluid and for monitoring the parameters of fluid usage in an ink jet printing system 1 independent from the electronics 15, controllers 11, and/or processors of the main printing system 2. Preferably, the base station micro-controller 23 also performs the functions of controlling communications between the base station 5 and the fluid bottle 6, decoding and generating code-hopping, setting date and time, performing EEPROM or other memory interfacing, controlling the maintenance module, generating error outputs, controlling the various indicators, etc.

Optionally, the micro-controller 23 of the base station 5 can also communicate with other components of the ink jet printing system 1, such as the main controller 11 and printheads 4, to transfer information therebetween. Preferably, this feature is for exchange of information and alarm function only, and no control capability is included. In other words, control of fluid delivery and monitoring of fluid usage is not dependent upon the electronics 15, controllers 11, or processors of the main printing system 2. The logic of the base station micro-controller 23 cannot be overtaken by the main controller 11 of the main printing system 2.

The base station 5 of the intelligent fluid delivery system 20 may include an internal clock or, preferably, a real time clock 51, as shown in FIG. 3. The internal clock 51 is used to periodically, and in conjunction with the micro-controller 23, interrogate the memory of the bottle transponder module 21. The clock 51 can be used periodically or at variable times, predetermined or otherwise. In operation, the base station transponder module 22 interrogates the bottle transponder module 21 to check the status of the fluid bottle 6 and/or the fluid media 8. For example, the expiration date of the fluid contained therein may be periodically checked in order to ensure that the shelf life of the fluid media has not expired. For example, the micro-controller 23 of the base station 5 may interrogate the memory of the bottle transponder module 21 to check the expiration date every time the printing system is started, every time a print job is initiated, or at predetermined time intervals. Preferably, the intelligent fluid delivery system 20 and internal clock 51 do not count down time intervals, but rather only interrogate the stored date and compare the stored date to the date of the internal clock 51 of the base station 5. By reading the expiration date code from the fluid bottle 6 and comparing it to the value of the real time clock 51 in the base station 5, an indicator 31 can be activated and/or the intelligent fluid delivery system 20 can be interrupted until the user acknowledges an alarm condition, for example, if the fluid media is out of date. The clock 51 can also be used for "time-out" of fill cycle, if the reservoir 7 does not fill within a predetermined time period.

As shown in FIGS. 4A–4C, the intelligent fluid delivery system 20 also includes a fluid measurement and metering system 30 for detecting a level of fluid media 8 in the reservoir 7, for controlling fluid delivery from the fluid bottle 6 to the reservoir 7, and for monitoring fluid usage. Ink measurement/metering can be accomplished, for example, using a level detection system having a float 34 and fluid level detection switches 33 to measure and/or detect the level of fluid media 8 in the reservoir 7 and a solenoid operated fluid delivery valve 31 to meter a known quantity of fluid media 8 into the reservoir 7 from the fluid bottle 6 on the command of the base station micro-controller 23.

Preferably, the fluid level detection switches 33 of the fluid measurement and metering system 30 include one or more level switches for determining a level of fluid media 8 in the reservoir 7. As shown, the fluid level detection switches 33 include a high level switch 57, a low level switch 58, and an empty level switch 59. The high level switch 57, low level switch 58, and empty level switch 59 are disposed in the reservoir 7 for determining a high level, a low level, and an empty level, respectively, of fluid media 8 in the reservoir 7. A solenoid 32 can be electronically linked to the reservoir level detect switches 57, 58, 59 to open/close fluid delivery valve 31, accordingly. Preferably, each fill cycle would correlate to a known amount of ink metered.

The base station 5 includes a fluid delivery, or release, valve 31 positioned proximate the opening of the bottle connection 28 of the base station 5 for controlling a flow of fluid media 8 between the fluid bottle 6 and the reservoir 7. The fluid delivery valve 31 can be controlled by a solenoid 32, or other suitable means. In the open position, the fluid delivery valve 31 allows fluid 8 to flow from the fluid bottle 5 to the reservoir 7 by conventional means, such as gravity feed. In the closed position, the fluid delivery valve 31 prevents fluid media 8 from flowing between the bottle 5 and the reservoir 7.

The base station includes a plurality of indicators 35 for indicating different states of the base station 5. Preferably, the indicators 35 are LEDs and include different colors to indicate different states. For example, the indicators can include a green LED to indicate system ready, a yellow LED to indicate bottle not detected, a red LED to indicate fluid level low/empty, an orange LED to indicate a fluid bottle error condition, etc.

The base station 5 also includes one or more switches 36. The one or more switches 36 can include, for example, a power switch (not shown) for turning the base station 5 on and off, a reset switch (not shown) for resetting an error condition of the base station 5, an over-ride switch (not shown) for acknowledging a condition of fluid delivery, and the like.

Figure 7:
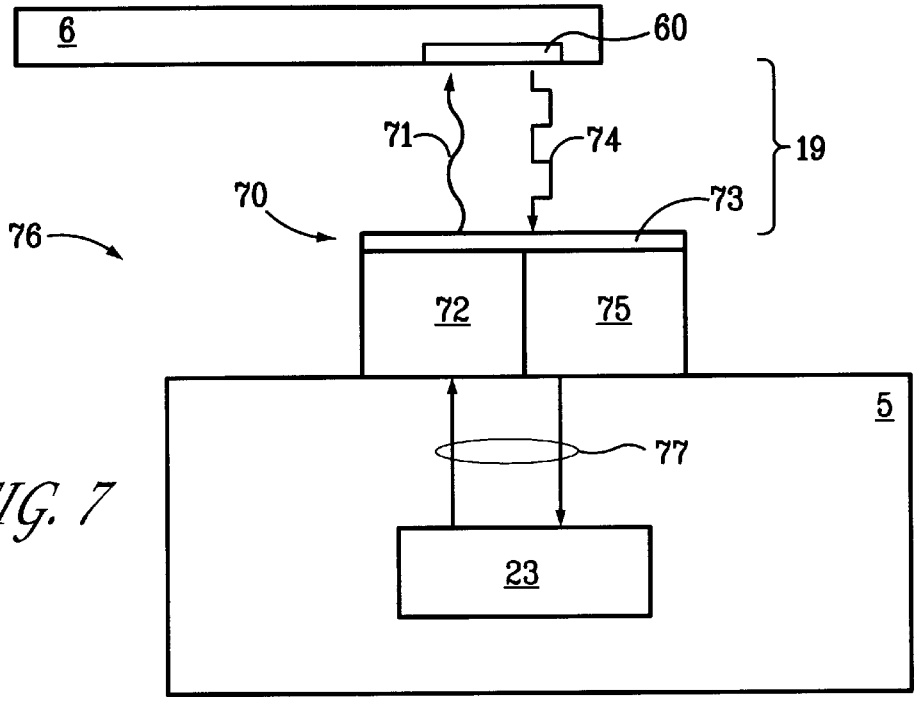
FIG. 7 shows an exemplary RFID transponder system in accordance with the present invention for use in fluid bottle discrimination and identification in an intelligent fluid delivery system.

As shown and described, the intelligent fluid delivery system 20 includes a base station transponder module 22 that is capable of communicating with the bottle transponder module 21 in order to transmit information between the base station 5 and the bottle 6. During operation, a communication link 19 is formed, as shown in FIGS. 2 and 7, between the two transponder modules 21, 22 and information can be transmitted therebetween. The communications link 19 can include either a hardwired connection or a wireless connection. In a preferred embodiment, the transponders 21,22 communicate using wireless communications.

In a preferred embodiment, the bottle and base station transponder modules of the WFDS include a radio-frequency (RF) identification transponder module (also referred to herein as a "RFID transponder module") which is used to discriminate and identify the type of fluid bottle and fluid media (hereinafter also referred to as "ink bottle" and "ink", respectively) that has been inserted into the base station. The present invention provides a radio-frequency detection mechanism so that it can be ascertained with near certainty that an inserted fluid bottle is an appropriate fluid bottle having a fluid media that is compatible with the ink jet printing system (e.g., suitable for use with the other components of the ink jet printing system). In addition to foreign object discrimination, the RFID transponder module system can preferably also identify the type of fluid bottle and the characteristics of the fluid media contained therein in order to control fluid delivery and set selected fluid delivery parameters thereby optimizing the performance of the fluid delivery system for a particular fluid media. The RFID transponder module system is a highly effective discriminant that can be used in the intelligent fluid delivery system of the present invention in order to ensure that an appropriate fluid bottle has been inserted. Furthermore, the RFID transponder module system can also be used to prevent a refilled bottle having an unknown or non-compatible fluid media from unknowingly being introduced into the base station. It should be noted that the term RF, as used herein, refers to the transmitted signals, which may include signals outside the normal RF range, such as signals higher than RF (e.g., micro-range) and signals lower than RF (e.g., A/C analog signals).

RFID is a non-contact (e.g., wireless) method of storing and retrieving information in a small RFID module mounted on any object, such as the fluid bottle and the base station, which requires identification and validation prior to use. RFID module technology is similar to bar code technology, however the RFID module is much more sophisticated than the bar code. RFID modules are capable of storing about 100 times the information, in a smaller space, without the environmental problems that bar codes typically face.

Figure 5A:
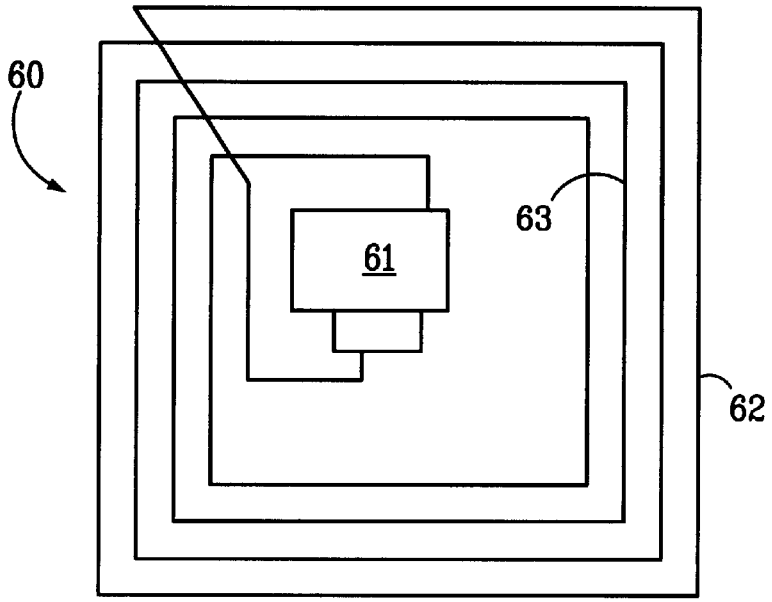
FIGS. 5A and 5B show a plan view of alternative embodiments of exemplary RFID transponder modules for use in fluid bottle discrimination and identification in an intelligent fluid delivery system.
Figure 5B:
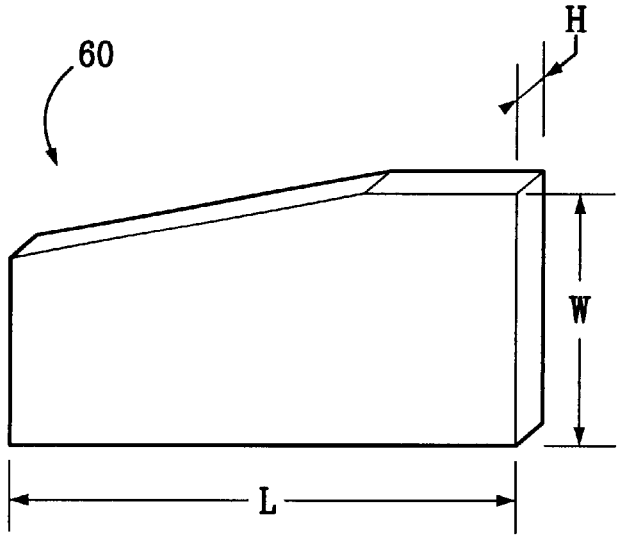

FIGS. 5A and 5B show exemplary RFID transponder modules 60 that can be used in the discrimination and identification of the fluid bottle 6 by the base station 5. FIG. 5A shows a label type RFID transponder module 60 that offers an ultra-thin form factor that can be laminated into, for example, a paper or plastic labels. FIG. 5B show an exemplary compact wedge type RFID transponder module 60 that also offers an ultra-compact package that may be disposed within the fluid bottle 6 or base station 5. FIG. 5B shows a perspective view of an exemplary wedge type RFID transponder module 60 having physical dimensions: length L, width W, and height H.

Figure 6:
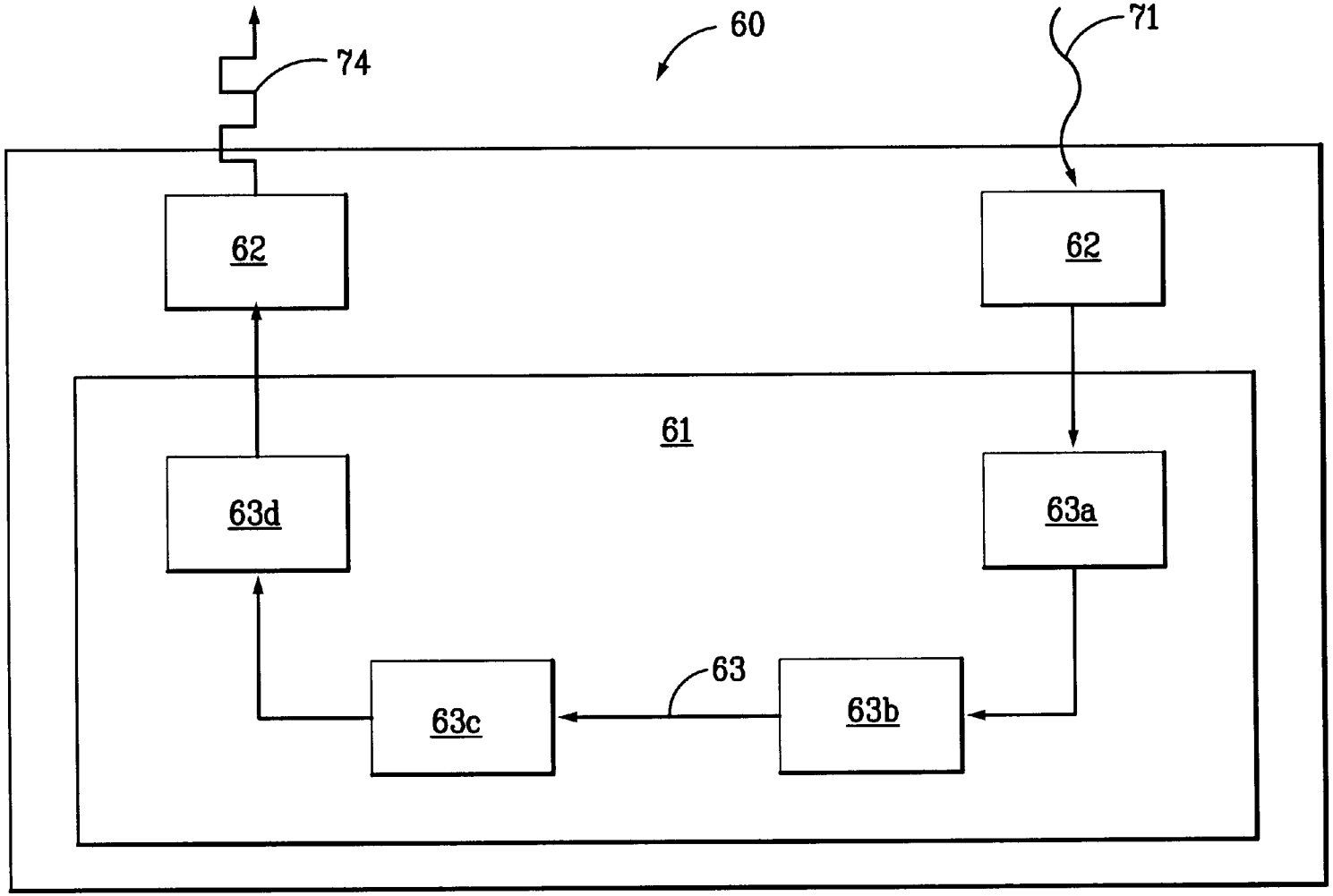
FIG. 6 shows a block diagram of an exemplary RFID transponder module in accordance with the present invention.

FIG. 6 is a block diagram showing an exemplary RFID transponder module 60. As shown, the RFID transponder module 60 includes a transponder chip 61 and an antenna 62. The transponder chip 61 includes an integrated circuit (IC) 63 which includes a receiver device 63*a,* RF processing 63*b* and memory 63*c* functions, and a transmitter device 63*d* disposed on the transponder chip 61. The transponder chip 61 is preferably a RFID ASIC. The RFID transponder module 60 provides a wireless link that connects the fluid bottle 6 with a micro-controller of the base station 5 for discrimination/identification of the fluid bottle 6.

As shown in FIG. 6, the RFID transponder module 60 can be activated by a RF signal 71 transmitted from, for example, the base station transponder module 22. In response to the source signal 71, the RFID transponder module 60 disposed on, for example, the fluid bottle 6, transmits a response signal 74 which is detected by, for example, the base station transponder module 22 thereby discriminating/identifying the fluid bottle 6.

The transponder chip 61 is the heart of the RFID transponder module 60 and carries the encoded ID and characteristics of the replaceable printing components 3, such as the fluid bottle 6 and the fluid media 8 contained therein. The transponder chip 61 and antenna 62 are preferably contained within the RFID transponder module 60. The RFID transponder module 60 can include a label type RFID transponder module having an ultra-thin profile having a minimal height dimension (as shown in FIG. 5A), a wedge type (as shown in FIG. 5B), or any other suitable compact type transponder module. Preferably, the transponder module 60 is adapted and packaged in a variety of sizes and form factors to suit the specific application.

The RFID transponder module 60 can be contained in a pressure sensitive adhesive (PSA) sticker wherein the RFID transponder module 60 is suspended in an optically clear binder that is coated/printed on the sticker substrate (e.g., white vinyl). PSA with a protective liner can be applied to the backside of the sticker substrate. Alternatively, the RFID transponder module 60 can be disposed in a plastic filler for injection molded parts/transponder modules, or applied via suspension in an adhesive compound such as UV curable epoxy, or using any other suitable method. The replaceable parts requiring identification and discrimination (e.g., the fluid bottle and base station) can either be molded, printed, or tagged with the RFID transponder module 60.

The RFID transponder module 60 can be any commercially available RFID transponder module suitable for electrical communication and information storage. Preferably, the RFID transponder module 60 includes a microchip transponder module having properties of a relatively small size and the capability of working in an ink-laden environment. Any suitable microchip transponder module using RFID technology can be used.

FIG. 7 shows an exemplary RFID system 76 in accordance with the present invention. As shown in FIG. 7, the RFID system 76 includes a RFID transponder module 60, and a RF source 72 and a detector 75 of RF for discriminating/identifying an replaceable printing component 3, such as a fluid bottle 6, that is inserted into a base station 5. Although not a requirement, the RFLD transponder module 60 is preferably disposed on the body of the fluid bottle 6 such that the RFID transponder module 60 is positioned proximate the RF source 72 when the fluid bottle 6 is inserted into the base station 5. This can include the sidewall, neck, or cap of the bottle.

As shown in FIG. 7, the RFID transponder system 76 includes a RFID transponder module 60, a RF source device 72, a detector device 75 of a transponder module response signal, and a data processing device 23, which is preferably the micro-controller 23 of the base station 5. Any RF source can be used that emits RF sufficient to energize the transponder 61 of the RFID transponder module 60. The RF source 72 and the detector 75 are preferably integrated into a single reader device 70. The RF source 72 interrogates the RFID transponder module 60 by broadcasting RF energy (a RF source signal 71) via a transmitting antenna 73 over a fixed or adjustable area. This broadcast area may be referred to as the read zone or reader footprint. The RFID transponder module 60 on the fluid bottle 6 reflects a small part of the RF energy back to a receiving antenna 73 coupled to the detector 75. The detector antenna can be a separate antenna (not shown), or preferably is the same integrated antenna 73 used by the RF source 72 to broadcast the RF signal 71. The detector 75 is capable of detecting a return signal 74 from the RFID transponder module 60 and communicating this information to a data processing device 23, which is preferably the base station micro-controller, for processing of the response signal 74. The response signal 74 can be used to discriminate the tagged object and to manipulate one or more computer processes, including recording of information, activation or deactivation of fluid delivery, setting or adjusting of fluid delivery parameters, and the like.

The RF source 72, detector device 75, and antenna 73 can be provided a single reader device 70 within the base station 5. The reader 70 generates, transmits, receives, and reads the RF transmissions. Preferably, the reader 70 generates the RF signal 71 and sends this request for identification information to the transponder module 60. The RFID transponder module 60 responds by transmitting the response signal 74 with the respective information, which the detector 75 portion of the reader 70 receives and formats, and then forwards to the data processing device 23. The model, size, and packaging of the reader 70 is preferably determined based on the particular application.

The reader device 70 is an integrated device including the RF source 72 and the detector 75. The reader 70 performs several functions, including producing a low-level radio-frequency magnetic field. The RF magnetic field can service as a "carrier" of power from the reader 70 to a passive RFID transponder module 60. When the RFID transponder module 60 is brought into the magnetic field produced by the reader 70, the recovered energy powers the integrated circuit (IC) 63 in the RFID transponder module 60, and the memory contents of the RFID transponder module 60 on the fluid bottle 6 are transmitted back to the reader 70. Once the reader 70 has checked for errors and validated the received data, the data is decoded and restructured for transmission to a data processing device 23 in the required format. Alternatively, each of the devices described above can be a stand-alone device that are electrically or electromagnetically (RF) coupled together.

The antenna 73 can comprise any suitable transmission and receiving device including a ferrite rod antenna which is a short cylindrical device or a gate type antenna. The type of antenna is preferably selected to match the design requirements and preferred read range of the RFID system. A gate antenna is well suited for tight areas where reading field coverage needs to be maximized.

Preferably, the data processing device 23 comprises the existing micro-controller 23 of the base station 5. The micro-controller 23 is adapted to receive an output signal from the detector 75 portion of the reader 70 and to determine the validity and characteristics of the inserted fluid bottle 6 and fluid media 8.

During operation, the RF source transmitter 72 sends out an electromagnetic wave (e.g., a RF signal) via the antenna 73 to establish a zone of surveillance and interrogate a RFID transponder module 60. When a RFID transponder module 60 enters this zone, the electromagnetic energy from the reader 70 begins to energize the IC 63 in the RFID transponder module's transponder 61. Once the IC 63 is energized, it goes through an initialization process and begins to broadcast its identity. Preferably, this process utilizes a low energy, back-scattering technology that selectively reflects or back-scatters the electromagnetic energy back to the reader 70. The receiving and detecting circuits 75 in the reader 70 sense and decode this back-scattered signal, identify the RFID transponder module 60, and then determine whether the fluid bottle 6 is suitable for use in the base station 5. In addition, the proper fluid delivery settings for that fluid bottle 6 and fluid media 8 can be determined based on the transponder module's response signal 74.

Figure 8A:
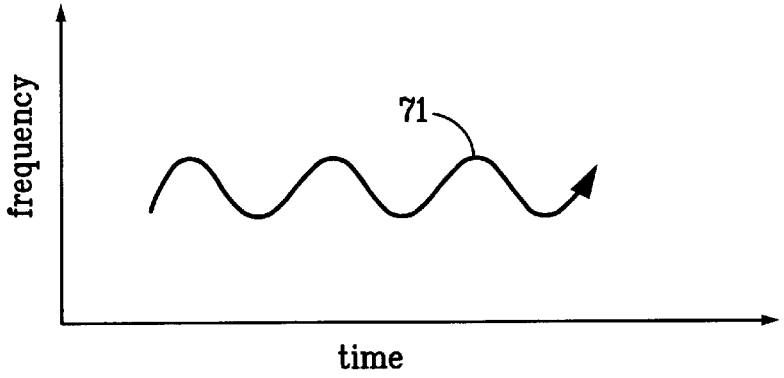
FIG. 8A is a graph showing an exemplary RF input spectrum for a RFID transponder module in accordance with the present invention.
Figure 8B:
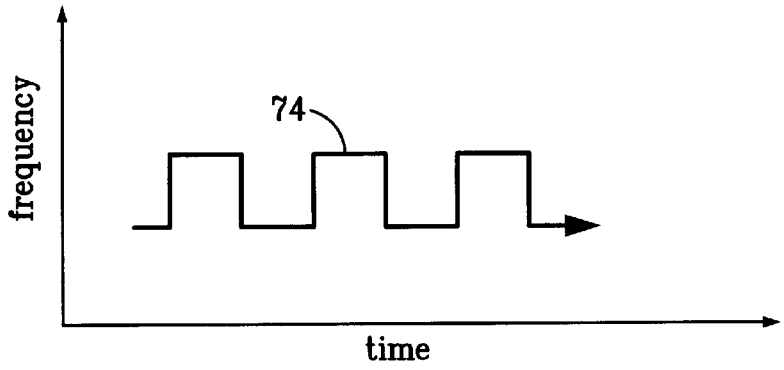
FIG. 8B is a graph showing an exemplary output spectrum for a RFID transponder module in accordance with the present invention.

FIG. 8A is a graph illustrating an exemplary RF source signal 71. As shown, the RF source signal 71 is preferably an analog signal having a predetermined frequency and amplitude. FIG. 8B is a graph illustrating an exemplary response signal 74 in accordance with the present invention. Although the response signal 74 can be an analog or a digital signal containing the fluid bottle ID code as well as other characteristics of the fluid bottle 6 and fluid media 8, it is preferably a digital signal. In those embodiments where the response signal 74 comprises an analog signal, the response signal is preferably at a different wavelength than the RF source signal 71.

The RFID transponder module may be classified based on how it is powered as one of an active transponder module and a passive transponder module. In addition, the RFID system can be classified according to its memory type as one of read-only, write-once-read-many (WORM), and read-write.

The RFID transponder modules 21, 22 of the present invention can be either active or passive. The classification of active or passive describes the power of the transponder module. Preferably, the bottle RFID transponder module 21 is a passive transponder module (e.g., battery-less) which is powered by the reader signal of the base station RFID transponder module 22 which is preferably an active transponder module. The passive bottle RFID transponder module is totally powered by the magnetic field generated by the reader 70. The incoming radio signal which "wakes the transponder module up", energizes the bottle RFID transponder module 21, and provides sufficient power for the bottle RFID transponder module 21 to respond with its requested data. This contributes to very high reliability and long service life, which allows for the RFID transponder modules 21, 22 to be mounted one time during their lifetime and allows the bottle RFID transponder module 21 to be mounted in many more locations than other devices that need maintenance or battery replacement. Passive transponder module systems typically use frequencies in the range of about 120 to about 130 kHz range. Alternatively, the bottle RFID transponder module 21 can be an active transponder module.

As stated, there are several memory types available for the RFID transponder module, including read only, write-once-read-many (WORM), and read/write. Preferably, the RFID transponder modules 21, 22 of the present invention are read/write RFID transponder modules. This type of transponder module allows the user to write to the RFID transponder module to encode certain fluid bottle and fluid media features. The read/write system can also read and change, or add information to, the transponder module as they come into proximity of the reader. The encoded information can be read as many times as desired over the life of the RFID transponder modules.

RFID is an automatic identification technology that speeds the collection of data and eliminates the need for human operations in the process. With RFID technology, no line of sight or direct contact is required between the reader and the transponder module. Since RFID does not rely on optics, it is ideal for dirty, oily, wet or harsh environments, including an ink-laden environment. RFID transponder modules and readers have no moving parts and therefore the RFID system rarely needs maintenance and can operate flawlessly for extended periods of time. Passive RFID transponder modules have an extremely long life, usually 10 years or more, and will usually outlast the asset to which they are attached. Also, wireless RFID communications have virtually no problems associated with electrostatic interference.

The RFID transponder modules of the present invention are less complex and more economical to manufacture than other types of marker systems used for fluid bottle discrimination in an ink jet printing system. The RFID transponder module system is very fast and highly repeatable and thus provides a manufacturing advantage.

The intelligent fluid delivery system 20 can include both operational and non-operational information that is communicated between the fluid bottle 6 and the base station 5. For example, non-operational information transmitted from the fluid bottle 6 to the base station 5 can include the type of bottle, the manufacturer of the bottle (including manufacturer ID code), and bottle lot number information. Operational information transmitted from the fluid bottle 6 to the base station 5 can include, for example, ink type, ink quantity, expiration date or shelf life information. Operational information transmitted from the base station 5 to the fluid bottle 6 can include, for example, ink usage information and non-operational information transmitted from the base station 5 to the fluid bottle 6 can include, for example, bottle security information (e.g., code hopping).

Preferably, information flows both ways between the base station 5 and the fluid bottle 6 in the intelligent fluid delivery system 20. For example, information, such as the type of bottle, type of ink, quantity of ink, lot number, expiration date or shelf life, etc., can be read from the bottle memory by the transponder at the base station and information, such as ink usage and bottle security, can be stored in the memory of the base station and/or transmitted from the base station and stored to the bottle memory.

Preferably, the intelligent fluid delivery system 20 is programmed to record information relating to the fluid bottle and fluid media in order to ensure that these components are within the printer specifications and are compatible with the other printer components. For example, if an unknown ink is delivered from the base station 5 to the main printing system 2, then the ink jet printing system 1 may be damaged. It is desirable to record this type of information for use when servicing or repairing the printing system. In addition, the intelligent fluid delivery system 20 may be programmed to only deliver fluid to the main printing system 2 if there is a positive communication between the bottle transponder module 21 and base station transponder module 22, and/or if the user acknowledges an alarm indications. In other words, if an unknown bottle were installed, the user would have to acknowledge an alarm and consciously decide to continue operating the printing system with the unknown fluid installed.

The following description of the system functionality is provided to better illustrate how an exemplary intelligent fluid delivery system would function in an ink jet printing system. FIGS. 9–14 are flow charts illustrating the method of intelligently monitoring the parameters of fluid delivery and fluid usage at the base station independent of the controller of the ink jet printing system in accordance with the present invention. The exemplary scenarios given below, with respect to FIGS. 9–14, demonstrate how one embodiment of the intelligent fluid delivery system would function over the life of many bottles of ink and also an unknown ink condition.

FIG. 9 is a flowchart illustrating an initial dry ink jet printing system installation process 900 at a user site. The user installs a new bottle of known ink onto the base station, or nest, which is compatible with the other components of the ink jet printing system, at step 905. The base station reads the bottle of ink, at step 910. The base station micro-controller receives the information and determines whether the bottle is a known bottle type and whether it contains the right type of ink, at step 915. For example, the information can include the bottle serial number (or ID code), a code hopping data number, the expiration date, the quantity of ink, whether the ink is compatible with the base station, etc. The micro-controller determines whether the bottle is a known bottle, at step 920. If a known bottle is detected, then the process continues to step 935. If a known bottle is not detected, then an alarm indication is given, at step 925. Preferably, ink delivery is interrupted, at step 933, if, for example, a known bottle is not detected, the bottle is not detected at all, or an electronically empty bottle is detected, until the alarm condition is acknowledged and overridden at step 925. When the alarm condition is acknowledged and overridden, at step 930, then the process continues at step 935.

At step 935, the level of ink in the base station reservoir is determined by the micro-controller. Since this is a new installation, the base station reads ink out (e.g., dry reservoir). Optionally, an Ink Out LED can be illuminated. At step 940, the bottle solenoid valve opens allowing ink to flow, at step 945, from the bottle to the reservoir of the base station for a predetermined fill cycle of, for example about two minutes, or until the high-level float switch actuates. A code hopping number is generated by the base station, at step 950, and the code hopping number and fluid usage information can be transmitted to the bottle, at step 955. The information includes the date and time of fill cycle and a new code hopping number. Then this information is also fed onto the history chip at the base station, at step 960.

The above example assumes that the base station knows the current date and that the base station can accept a specific ink type (e.g., V-300 or A-1000). Preferably, desired base station features are programmed at the time of manufacturing with the date and base station type. A back-up power supply, such as a battery of, for example, 5 years lifetime, or some other means of retaining this data can be provided.

Figure 10:
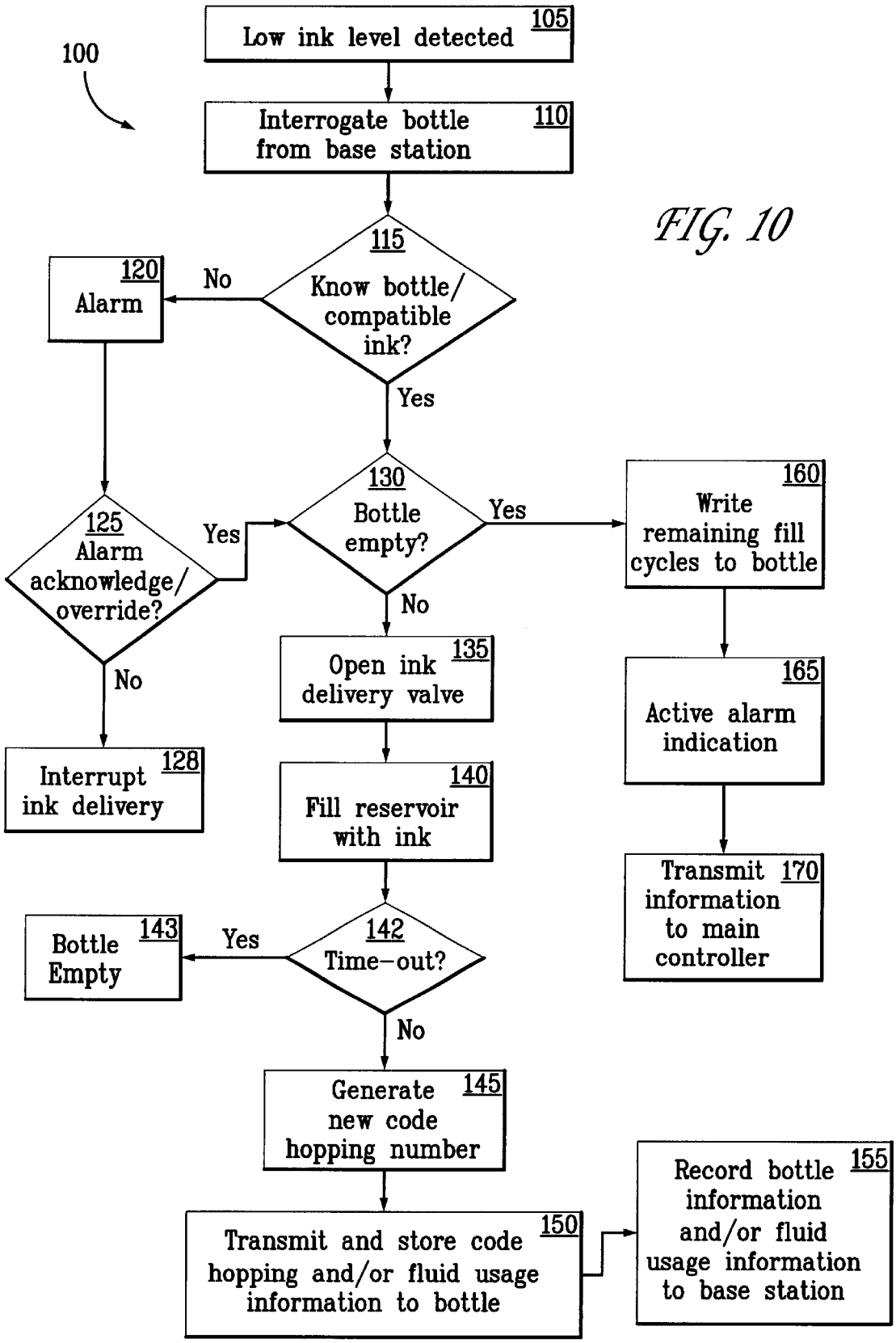
FIG. 10 is a flow chart illustrating the method of installing a new fluid bottle to commence the next metering cycle for the filling of the base station reservoir in accordance with the present invention.

The bottle is now being used normally and a known and compatible ink is being used. FIG. 10 is a flowchart illustrating the next metering cycle for the filling process 100 of the base station reservoir. Eventually, the float in the reservoir goes down to the low ink-metering switch and a low ink level is detected, at step 105. At this point, the ink bottle is interrogated, at step 110 and the information stored at the bottle, such as type of ink, the bottle serial number, a code hopping data number, and the expiration date, for example, is again read. The micro-controller determines whether the bottle is known and the ink type is correct (e.g., the ink is compatible, the expiration date is correct, the code hopping number is correct, etc.), at step 115. If it is the correct type, then the process continues at step 130. If it is not the correct type, then an alarm indication is generated at step 120. Preferably, ink delivery is interrupted, at step 128, until the alarm is acknowledged and overridden. The alarm is acknowledged and overridden, at step 125, and then the process continues, at step 130. Preferably, the system checks whether the bottle is empty, at step 130. If the bottle is not empty, then the bottle solenoid valve opens, at step 135, and ink flows into the reservoir, at step 140, for a predetermined fill cycle (e.g., about two minutes), or until the reservoir is filled to a level where the high level float switch is activated. Preferably, the intelligent fluid delivery system times the ink fill process and includes a "time out" function, at step 142, if the fill cycle exceeds a predetermined time period. If the system does not "time out" then the process continues at step 145. If the system does "time out" then, it is determined that the bottle is empty and an indications is provided at step 143.

At step 145, a new code hopping number is generated by the base station. The new code hopping number is transmitted to the bottle where it is stored, at step 150. The information can include the date and time of fill cycle base station serial number and a new code hopping number. This information can also feed onto the history chip on the base station, at step 155.

For example, a bottle may be given an initial electronic capacity of 25 (e.g., 25 ml) reservoir fill cycles and the physical capacity of the bottle may be 20 reservoir fill cycles. This gives a 20% over bottle capacity to allow for system inaccuracies. In this example, at approximately 20 cycles, the bottle is now physically empty. However, electronically approximately 5 fill cycles remain in the bottle memory. When the low level metering switch comes on, the solenoid turns on for the full 2 minutes and the high level float switch doesn't actuate, then the logic is that the bottle is physically empty. At this point the remaining bottle fill cycles are written to the bottle that it is indeed empty (electronically empty), at step 160. The Ink Low LED comes on and flashes, at step 165. Preferably, the capacity of the reservoir is high enough during normal printing (e.g., 20 min.) to allow the user to go get another replacement bottle and install this without interrupting the ongoing printing job. The Ink Bottle Error LED is off. A message may be sent from the base station to the printing system host computer, at step 170, that the ink level is low and that a new bottle needs to be installed. At this point it is assumed that a new or partially full bottle will be installed. If this is not done then the ink level will go down through normal printing to the level to actuate the 'Low Ink Switch'. The process in the Ink Out/Low Ink Level scenario described above with reference to FIG. 10 will then take place.

FIG. 11 shows a process 200 wherein the ink bottle is physically refilled to a full condition with unknown or non-compatible ink. Preferably, the existence of the bottle chip and code hopping number doesn't allow for reprogramming. At step 205, the refilled bottle is reinstalled on the same base station, or a different base station. The base station interrogates the bottle, at step 210. The base station determines whether the installed bottle is a known bottle, at step 215. If the bottle is a known bottle, then the process continues as shown in FIG. 10.

If it is determined at step 215 that the bottle is unknown, as indicated by, for example, the code hopping number and/or the lack of communications between the base station and the bottle, then it is determined that the bottle may by physically full of non-compatible ink (e.g., a refilled bottle). The bottle may have a number of electronic fill cycles left on it, or may be electronically empty. The base station determines whether the bottle is electronically empty, at step 220. If the bottle is not already electronically empty, then the bottle will cycle through (e.g., electrically eliminate) the remaining drain cycles, at step 225, and then electronically it becomes empty. If the bottle memory is already electronically empty, then the process continues directly from step 220 to step 235.

At this point, because the bottle is still dispensing ink yet is electronically empty, an alarm condition is initiated, at step 235. Preferably the alarm indicates at step 235, and requires that the user acknowledge and override the alarm, at step 240, that unknown ink is being used. For example, the Ink Bottle Error LED can indicate (e.g., flash). If the alarm is acknowledged and overridden at step 240, then this information is recorded at the base station, at step 245 and the ink delivery may be continued, at step 250. If the alarm condition is not acknowledged and overridden at step 240, then preferably, ink delivery is interrupted, at step 255, until the alarm is acknowledged/overridden back at step 240. The acknowledgement and override, at step 240, indicates that the user has acknowledge the use of an unknown bottle possibly containing a non-compatible ink and a conscious decision by the user to continue operation of the ink jet printing system with the unknown bottle installed in the base station.

The use of an unknown bottle and the acknowledgement/override by the user can be recorded at the base station, at step 245. For example, the use of the unknown bottle can be stored to a memory or history chip on the base station, at step 245, indicating that an unknown and possibly non-compatible type of ink was used with this system.

Optionally, the fluid usage feature may be disabled, at step 260, since there is no memory on the bottle to write to. Optionally, a message may be sent to the main controller of the main printing system, at step 265, that an unknown bottle of ink has been installed.

Figure 12:
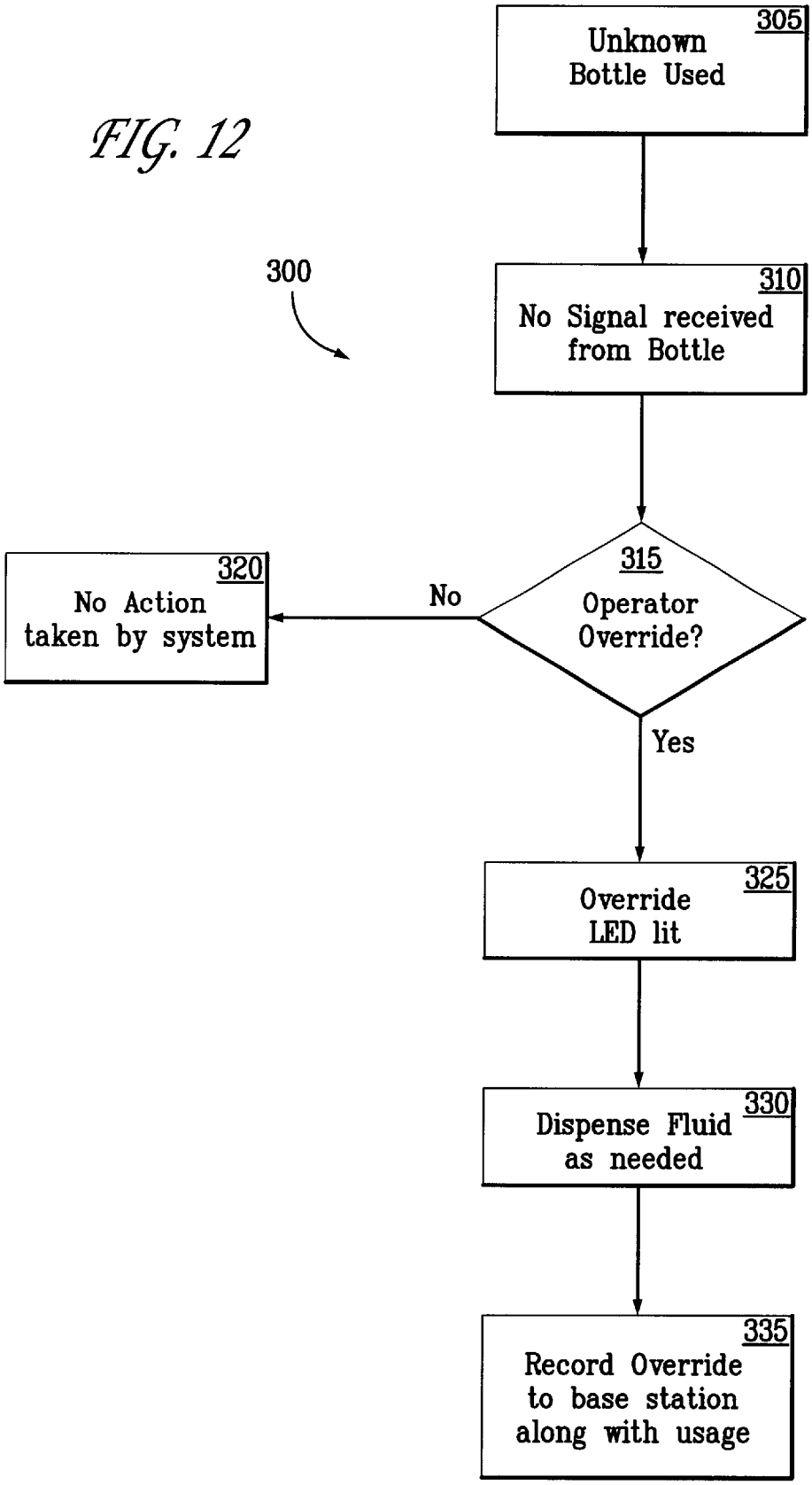
FIG. 12 is a flow chart illustrating an exemplary process wherein an undetected bottle has been installed in the base station in accordance with the present invention.

FIG. 12 shows an exemplary process 300 wherein an unknown fluid bottle has been inserted into the base station. As shown in FIG. 12, the unknown bottle process 300 includes the steps of determining that an unknown bottle has been used, at step 305. This can be determined by no signal being communicated between the bottle and the base station, at step 310. At this point, the micro-controller of the base station does not know that a bottle has been installed. An operator or user of the ink jet printing system can initiate an override function, at step 315. If an operator or user takes no action, then ink delivery does not occur, at step 320. If the operator activates an override, at step 315, then an override indicator illuminates, at step 325, and fluid is dispensed as required, at step 330. The override is recorded, at step 335, to the base station, preferably along with fluid usage information.

Figure 13:
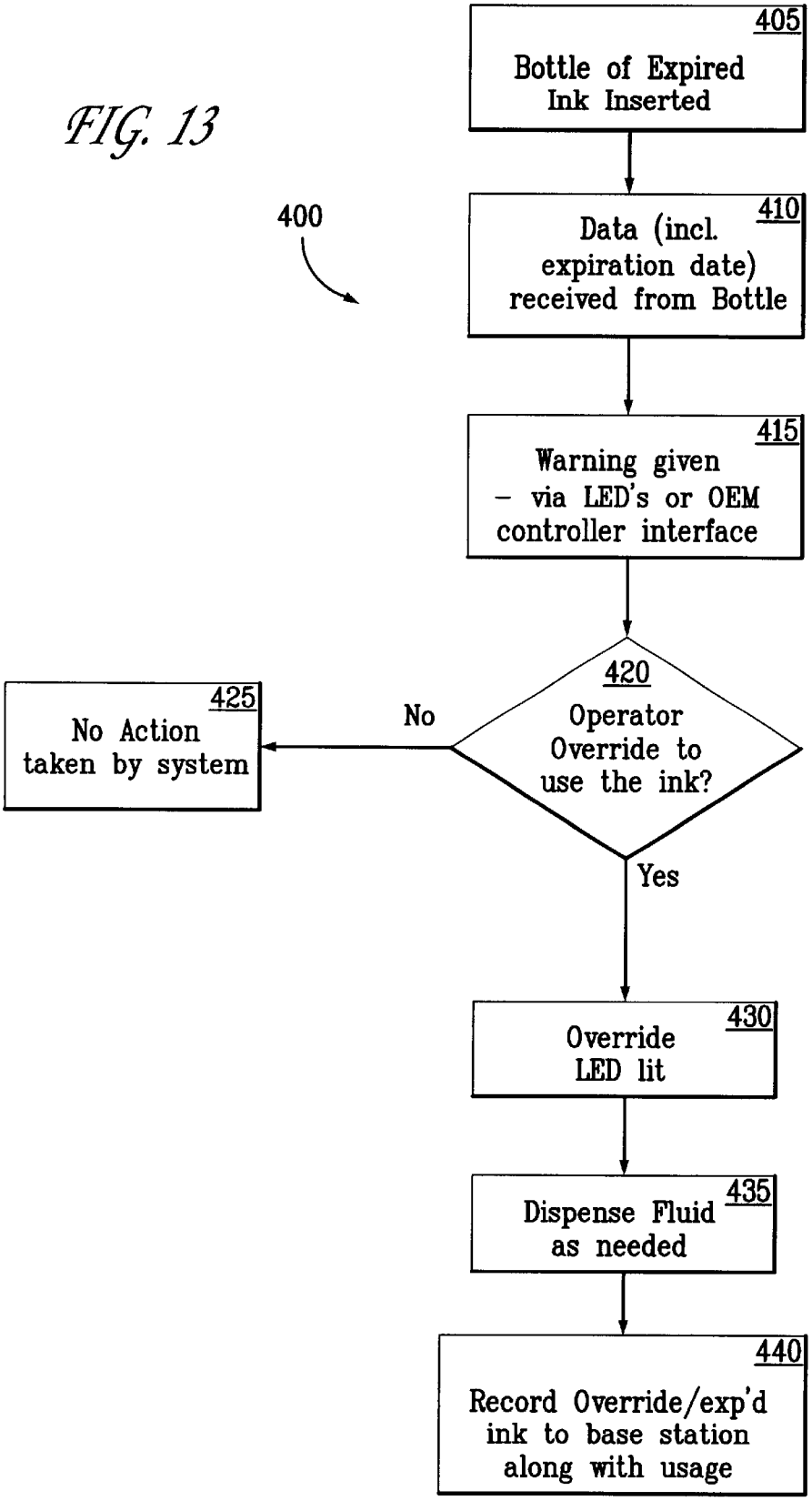
FIG. 13 is a flow chart illustrating an exemplary process wherein an expired bottle has been installed in the base station in accordance with the present invention.

FIG. 13 shows an exemplary process 300 wherein an unknown fluid bottle has been inserted into the base station. As shown in FIG. 13, an expired ink process 400 includes the steps of inserting a bottle having an expired ink into the base station, at step 405. Data is communication between the bottle and the base station, at step 410. This data can include, for example, data indicative of an expiration date of the ink that is transferred from the bottle to the base station. A warning or alarm is given to the operator, at step 415, that a bottle having an expired ink has been installed into the base station. The warning can include a alarm given at, for example, the LEDs at the base station or at the main controller interface. At step 420, the operator decides whether or not to override the alarm and used the expired ink. If the operator does not override the alarm, then no action is taken by the intelligent fluid delivery system, at step 425. If the operator initiates an override at step 420, then an indication can be given at step 430, such as an LED lighting up. The intelligent fluid delivery system than dispenses ink as needed, at step 435. The override of the expired ink condition is recorded, at step 440, to the base station, preferably along with fluid usage information.

Figure 14:
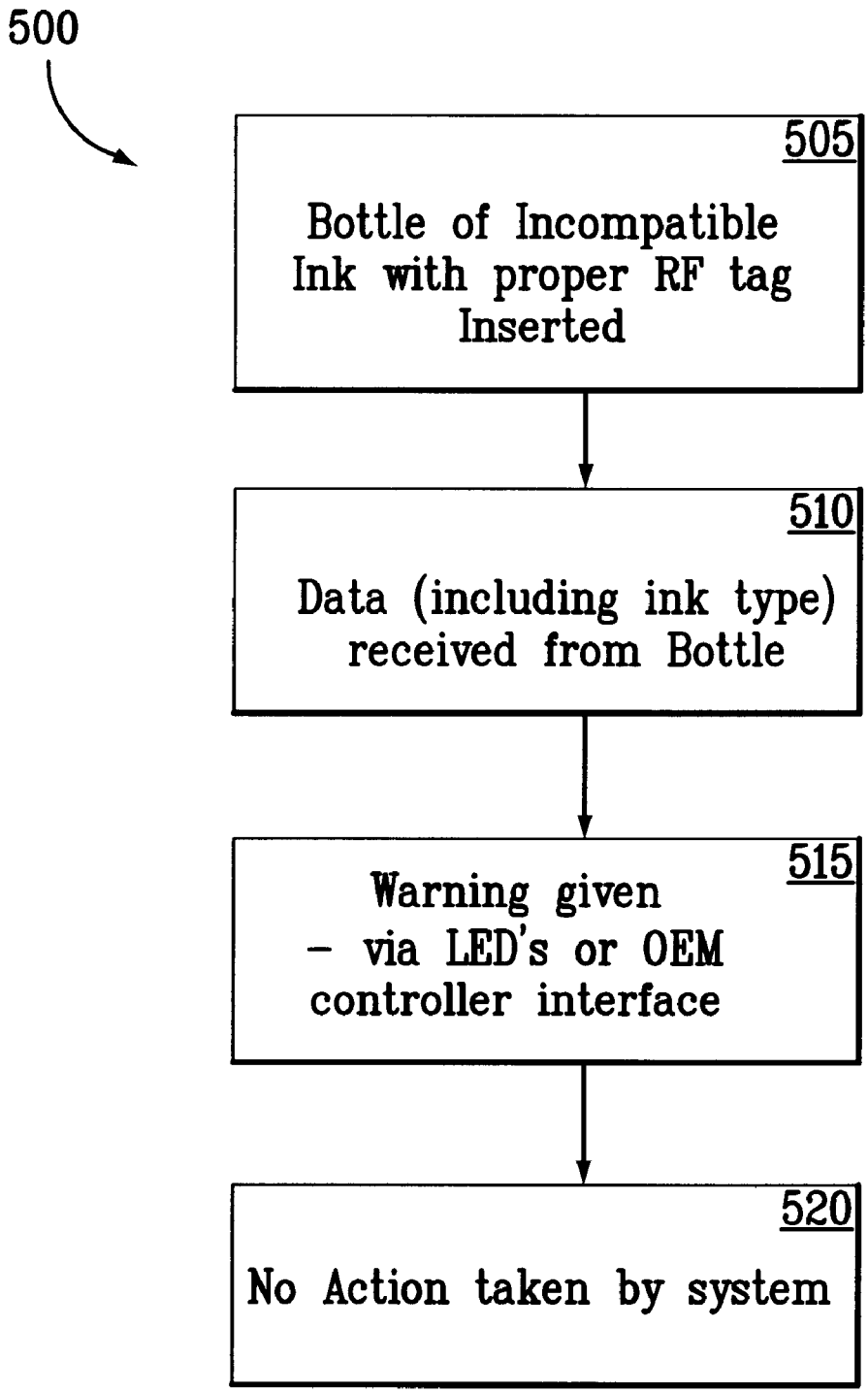
FIG. 14 is a flow chart illustrating an exemplary process wherein a non-compatible ink has been installed in the base station in accordance with the present invention.

FIG. 14 shows another exemplary process 400 wherein a bottle having a non-compatible ink has been inserted into the base station. As shown in FIG. 14, the incompatible ink process 500 includes the steps of installing a bottle having a proper transponder (e.g., RFID tag), but with an ink that is incompatible with the base station and/or the ink jet printing system into the base station, at step 505. Data, including information relating to the ink type, is communicated from the bottle to the base station, at step 510. An alarm indication is given at step 515 warning the operator that an incompatible ink has been installed into the base station. No action is taken by the intelligent fluid delivery system, at step 520.

Figures 15, 15A:
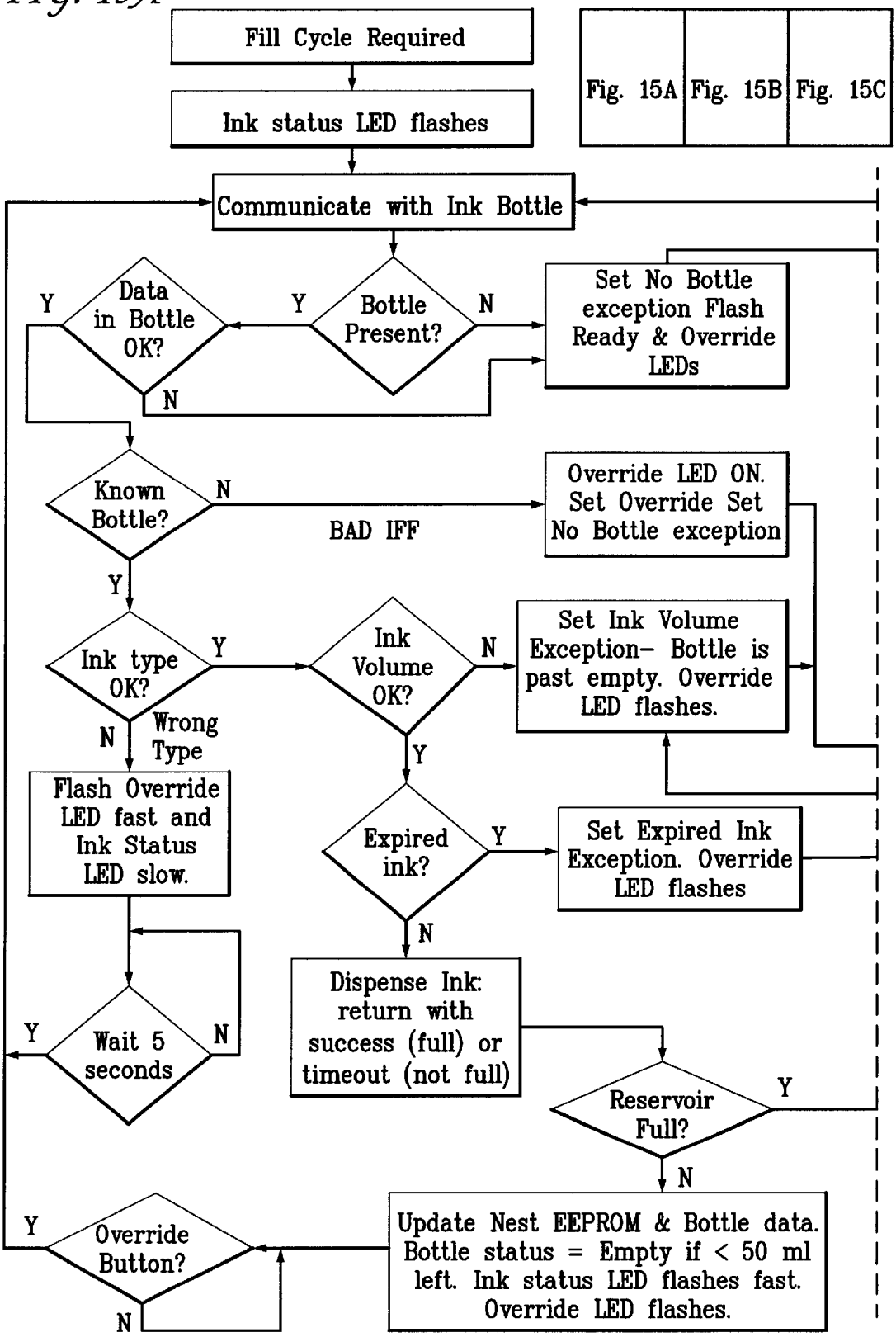
Figure 15B:
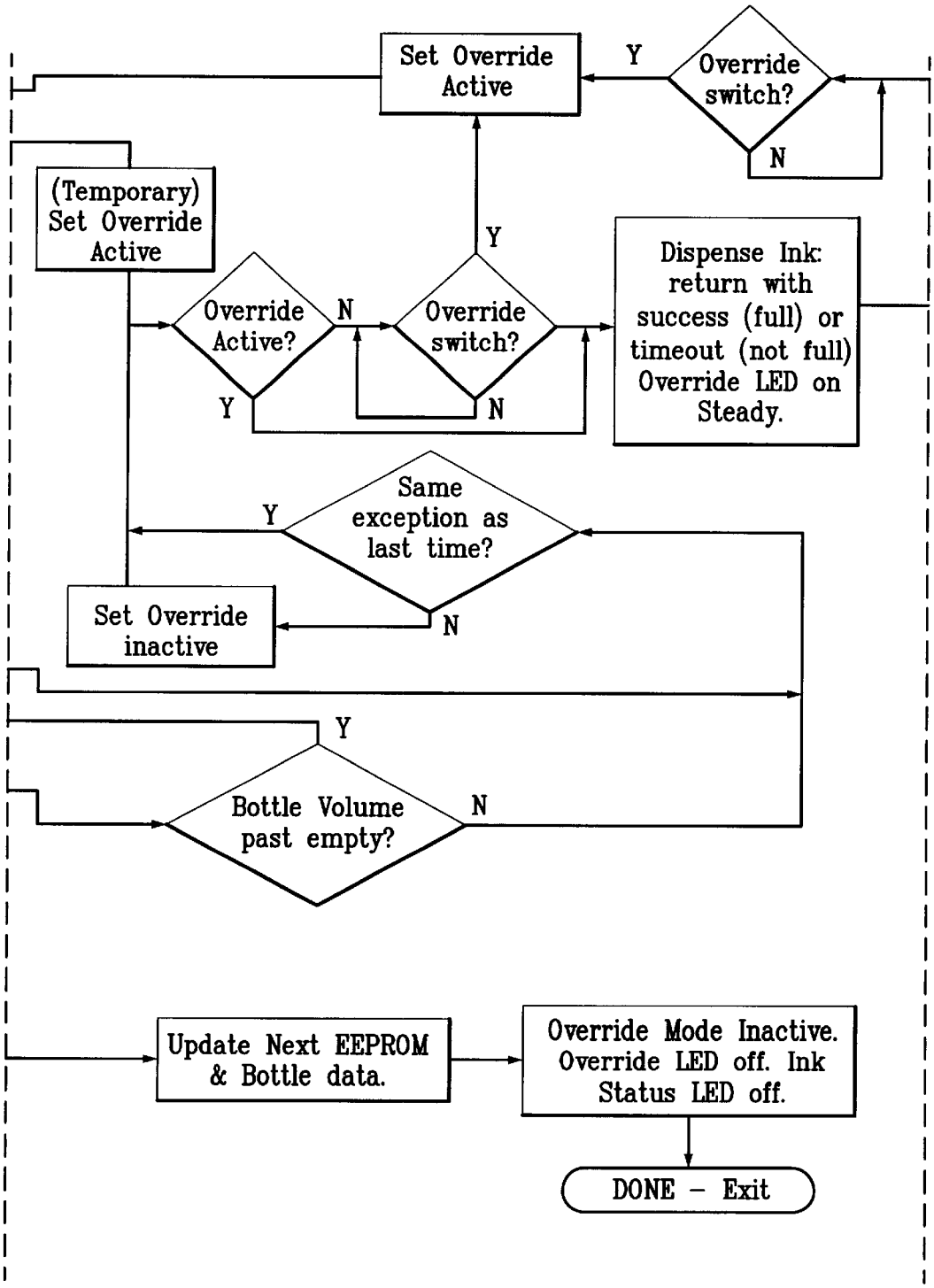

FIGS. 15A and 15B are flowcharts illustrating the overall logic of the intelligent fluid delivery system.

Advantages of the present invention include, for example: (1) the wireless communication between the bottle and the base station involving, for example radio frequency (RF) technology, which overcomes the problems of contamination from dust, hand oils and ink, and electrostatic discharge experienced with electrical ink cartridge to printer connections; (2) the stand alone ability of the base station to control fluid delivery and to monitor parameters of fluid usage in a jet printing system independent from the electronics, controllers, or processors of the main printing system; (3) preventing/reducing the use of unknown fluids in the ink jet printing system that may be non-compatible with the other components of the ink jet printing system thereby improving the reliability of the printing system by providing a nuisance or inconvenience factor whereby the user has to acknowledge and override an alarm indicator that an unknown bottle is installed in the base station; and (4) the purpose of collecting information relating to warranty and serving agreements so that these agreements can be adjusted based on recorded information that may affect one or both of these types of agreements.

It is to be understood, however, that even in numerous characteristics and advantages of the present invention have been set forth in the foregoing description, together with details of the structure and function of the invention, the disclosure is illustrative only, and changes may be made to detail, especially in matters of shape, size and arrangement of parts within the principles of the invention to the full extent indicated by the broad general meaning of the terms in which the appended claims are expressed.

What is claimed is:

1. A system for controlling fluid delivery and one or more parameters of fluid usage in a fluid jet printing system comprising:

a stand alone base station removably mounted to said fluid jet printing system, wherein said base station comprises:

a reservoir in said base station for periodically receiving a replenishment volume of a fluid media;

a fluid measurement and metering system disposed in said base station for detecting a level of said fluid media in said reservoir and for metering and measuring a flow of said replenishment volume of a fluid media flowing to said reservoir;

a base station transponder module having a memory and a transponder; and a micro-controller in said base station for controlling fluid delivery and monitoring one or more parameters of fluid usage, wherein said functions of controlling fluid delivery and monitoring one or more parameters of fluid usage are controlled by said micro-controller independent from the electronics, controllers, or processors of said fluid jet printing system;

a fluid bottle that is replaceable mounted to said base station for supplying said replenishment volume of a fluid media, wherein said fluid bottle comprises:

a cavity defined by one or more sidewalls of said fluid bottle for holding said fluid media;

a bottle transponder module having a memory and a transponder; and a communication link established between said base station transponder module and said bottle transponder module when said fluid bottle is inserted in said base station.

2. The system of claim 1, wherein said base station transponder module interrogates said bottle transponder module and wherein said bottle transponder module transmits information to said base station transponder module in response to said interrogation that is indicative of one or more of whether said fluid bottle is a known fluid bottle and whether said fluid media contained within said fluid bottle is compatible with said fluid jet printing system.

3. The system of claim 2, wherein said information transmitted from said bottle transponder module to said base station transponder module is recorded and stored for later use in enforcing, voiding, and/or adjusting one or more of warranty and service agreements if a non-compatible fluid is used in said fluid jet printing system and a failure occurs as a result of using said non-compatible fluid.

4. The system of claim 1, wherein said base station transponder module interrogates said bottle transponder module and wherein said flow of replenishment fluid media from said fluid bottle to said reservoir is interrupted if said fluid bottle is not positively identified by said micro-controller.

5. The system of claim 4, wherein said flow of replenishment fluid media from said fluid bottle to said reservoir is interrupted until a user acknowledges and overrides an alarm indication.

6. The system of claim 1, wherein said communication link is a wireless connection for communicating information between said base station and said fluid bottle.

7. The system of claim 6, wherein said transducers communicate via said wireless communication link using radio frequency (RF) techniques.

8. The system of claim 7, wherein said RF techniques further comprise radio frequency identification (RFID).

9. The system of claim 1, wherein said fluid jet printing system further comprises a main printing system having a main controller for controlling the printing operation of said fluid jet printing system, and wherein said micro-controller of said base station does not communicate with said main controller of said main printing system and said main controller does not control fluid delivery and fluid management.

10. The system of claim 1, wherein said fluid jet printing system further comprises a main printing system having a main controller for controlling the printing operation of said fluid jet printing system, and a communication link for transferring status and other information relating to fluid delivery and fluid usage from said micro-controller to said main controller, wherein said communication link is for the transfer of information only and does not provide any control function to or from said main controller of said main printing system.

11. A replaceable printing component for insertion into an intelligent fluid delivery system of an ink jet printing system, wherein said intelligent fluid delivery system has a RF source and a response signal detector for determining whether said replaceable printing component is suitable for use in said intelligent fluid delivery system, said replaceable printing component comprising:

a body;

a cavity defined in said body for holding a replenishment volume of a fluid media; and a replaceable printing component RFID transponder module on said body, wherein said replaceable printing component RFID transponder module receives a RF signal from said RF source and, in response to said source RF signal, emits a response signal toward said detector for detection which thereby identifies said replaceable printing component as being suitable for use in said intelligent fluid delivery system;

wherein said intelligent fluid delivery system is controlled by a micro-controller that operates independently from a main controller of said ink jet printing system to control fluid delivery.

12. The replaceable printing component of claim 11, wherein said response signal is used to discriminate said replaceable printing component for use in said intelligent fluid delivery system and wherein said response signal is recorded by said intelligent fluid delivery system.

13. The replaceable printing component of claim 11, wherein said replaceabl printing component RFID transponder module response signal is used to manipulate said fluid delivery.

14. The replaceable printing component of claim 11, wherein said response signal includes information relating to one or more of an encoded ID code and at least one operational characteristic which is used to identify said replaceable printing component.

15. The replaceable printing component of claim 14, wherein said information of said RFID transponder module response signal is stored for use in modifying one or more of a warranty and a service agreement if a non-compatible fluid is used in said ink jet printing system and a failure occurs as a result of using said non-compatible fluid.

16. The replaceable printing component of claim 11, wherein said replaceable printing component RFID transponder module further comprises a transponder, an antenna, and an integrated circuit having RF processing and memory functions which contain information relating to one or more of an encoded ID code, a fluid bottle characteristic, and a fluid media characteristic.

17. The replaceable printing component of claim 11, wherein said RF source and a response signal detector comprise a base station RFID transponder module, and wherein said base station RFID transponder module is a passive RFID transponder module and said base station RFID transponder module is an active RFID transponder module.

18. The replaceable printing component of claim 11, wherein said RF source and a response signal detector comprise a base station RFID transponder module, and wherein said base station and said base station RFID transponder modules comprises read/write RFID transponder modules.

19. A replaceable printing component for insertion into an intelligent fluid delivery system of an inkjet printing system, wherein said intelligent fluid delivery system has a RF source and a response signal detector for determining whether said replaceable printing component is suitable for use in said intelligent fluid delivery system, said replaceable printing component comprising:

a body;

a cavity defined in said body for holding a replenishment volume of a fluid media; and a RFID transponder module on said body, wherein said RFID transponder module receives a RF signal from said RF source and, in response to said source RF signal, emits a response signal toward said detector for detection which thereby identifies said replaceable printing component as being suitable for use in said intelligent fluid delivery system;

wherein said intelligent fluid delivery system further comprises a base station;

wherein said replaceable printing component further comprises a bottle;

wherein said RF source and a response signal detector comprise a base station RFID transponder module; and wherein said RFID transponder module is injection molded in said bottle and said base station RFID transponder module is sealed on a PCB disposed in said base station.

20. A replaceable printing component for insertion into an intelligent fluid delivery system of an ink jet printing system, wherein said intelligent fluid delivery system has a RF source and a response signal detector for determining whether said replaceable printing component is suitable for use in said intelligent fluid delivery system, said replaceable printing component comprising:

a body;

a cavity defined in said body for holding a replenishment volume of a fluid media; and a RFID transponder module on said body, wherein said RFID transponder module receives a RF signal from said RF source and, in response to said source RF signal, emits a response signal toward said detector for detection which thereby identifies said replaceable printing component as being suitable for use in said intelligent fluid delivery system;

wherein said intelligent fluid delivery system further comprises a base station and wherein said replaceable printing component further comprises a bottle;

wherein said fluid delivery from said bottle to said base station is permitted if said replaceable printing component is positively identified, and wherein said fluid delivery from said fluid bottle to said base station is interrupted if said replaceable printing component is not identified until an alarm condition is acknowledged.

21. A fluid jet printer system having an intelligent fluid delivery system comprising:

a main printing system, said main printing system comprising:

one or more printheads that move relative to a print media;

associated electronics for inputting printing system parameters to said main printing system and for and monitoring operation of said main printing system;

a fluid conduit for providing a flow of fluid media to said one or more printheads;

a main controller connected to said one or more printheads and said electronics for controlling the printing operation of said fluid jet printing system, wherein said movement of said one or more printheads relative to said print media is controlled by said main controller that also acts to activate said printheads to deposit ink droplets onto said print media to form images and text as said print media passes through a print zone;

a base station replaceably mounted to said main printing system, said base station comprising:

a reservoir for holding a first volume of fluid media, said reservoir being fluidly connected to said fluid conduit when said base station is properly mounted to said main printing system;

a fluid inlet valve for selectively opening and closing an inlet opening to said reservoir;

a measuring and metering system disposed in said base station for measuring a level of fluid media in said reservoir and for metering a volume of fluid media entering said reservoir;

a base station transponder module having a memory and transponder;

a micro-controller for controlling fluid delivery and one or more parameters of fluid usage including an operation of said fluid inlet valve, said measuring and metering system, and said base station transponder module;

a fluid bottle replaceably mounted to said base station, said fluid bottle comprising:

one or more side walls defining a cavity for holding a second volume of fluid media;

a fluid outlet opening positioned proximate said base station fluid inlet opening when said bottle is properly inserted in said base station;

wherein said cavity is in fluid communication with said reservoir when said fluid inlet valve is in said open position and wherein said second volume of fluid media is used to replenish said first volume of fluid media;

a bottle transponder module having a memory and transponder; and a communication link that is established between said base station transponder module and said bottle transponder module when said fluid bottle is properly inserted in said base station.

22. The system of claim 21, wherein said printheads, said base station, and said fluid bottle, require periodic repair or replacement.

23. A method for controlling fluid delivery and monitoring one or more parameters of fluid usage in a fluid jet printing system comprising the steps of:

providing a base station having a base station transponder module having transponder and memory capabilities;

providing a fluid bottle having a bottle transponder module having transponder and memory capabilities;

removably mounting said fluid bottle in fluid communication with said base station; and controlling fluid delivery from said fluid bottle to a reservoir of said base station by controlling one or more of metering said flow of fluid and measuring said flow of fluid from said bottle to said reservoir using a micro-controller disposed in said base station, wherein said micro-controller controls fluid delivery and fluid management independently of a main controller which controls the printing operation of said fluid jet printing system.

24. The method of claim 23, further comprising the step of transferring status and other information relating to fluid delivery and fluid usage from said micro-controller to said main controller via a communications link, wherein said communication link is for the transfer of information only and does not provide any control function to or from said main controller of said main printing system.

25. The method of claim 23, further comprising the steps of:

interrogating said bottle transponder module using a source signal generated by said base station transponder module;

emitting a response signal containing information relating to one or more of said fluid bottle and said fluid media from said bottle transponder module toward said base station transponder module; and controlling a flow of fluid media from said fluid bottle to said base station based said information contained in said response signal emitted from said bottle transponder module.

26. The method of claim 25, further comprising the step of storing said information contained in a response signal at said base station.

27. The method of claim 26, further comprising the step of enforcing, voiding, and/or adjusting one or more of warranty and service agreements based on said information contained in said response signal recorded at said base station if a failure occurs due to one of using an unknown fluid bottle and using a non-compatible fluid media.

28. The method of claim 25, further comprising the step of establishing a wireless communication link to accomplish said steps of interrogating and emitting.

29. The method of claim 28, further comprising the step of using Radio-Frequency techniques to establish said wireless communication link.

30. The method of claim 23, wherein said step of providing a base station further comprises the step of removably mounting said base station to said fluid jet printing system.

31. The method of claim 23, further comprising the steps of removing said base station from said fluid jet printing system and adding new intelligence to said fluid jet printing system by installing an upgraded base station having an upgraded micro-controller to said fluid jet printer system.

32. The method of claim 23, further comprising the steps of measuring an amount of ink usage to ensure a single use only of said fluid bottle.

33. A method for collecting data relating to fluid delivery and fluid usage in a fluid jet printing system comprising the steps of:

monitoring one or more parameters indicative of fluid delivery between a replaceable fluid bottle and a reservoir of a replaceable base station;

monitoring one or more parameters indicative of fluid usage between said reservoir of said base station and said fluid jet printing system;

storing said one or more parameters indicative of fluid delivery and said one or more parameters indicative of fluid usage to a memory of said base station;

transferring and storing information relating to said fluid bottle and said fluid media from a memory of said fluid bottle to said memory of said base station;

transferring and storing information relating to said fluid usage from said base station memory to said memory of said fluid bottle;

controlling a printing operation of said fluid jet printing system using a main controller of said main printing system; and controlling fluid delivery and fluid management using a micro-controller of said base station, wherein said main controller does not control fluid delivery and fluid management.

34. The method of claim 33, wherein said steps of transferring further comprise using radio frequency identification techniques.

35. The method of claim 33, further comprising the steps of ascertaining whether another replacement fluid bottle inserted into said base station is an appropriate fluid bottle having a fluid media that is compatible with the fluid jet printing system and storing said result of said step of ascertaining in said base station.

* * * * *

UNITED STATES PATENT AND TRADEMARK OFFICE

CERTIFICATE OF CORRECTION

PATENT NO. : 6,467,888 B2
DATED : October 22, 2002
INVENTOR(S) : Wheeler et al.

It is certified that error appears in the above-identified patent and that said Letters Patent is hereby corrected as shown below:

Title page,
Item [56], References Cited, U.S. PATENT DOCUMENTS,
"4,901,093" reference, please delete "347/70" and insert therefor -- 399/25 --.
"4,961,088" reference, please delete "399/25" and insert therefor -- 346/140R --.
"5,021,828" reference, please delete "399/24" and insert therefor -- 355/209 --.
"5,049,989" reference, please delete "347/19" and insert therefor -- 346/1.1 --.
"5,132,729" reference, please delete "399/24" and insert therefor -- 355/203 --.
"5,138,344" reference, please delete "347/86" and insert therefor -- 346/140R --.
"5,184,181" reference, please delete "399/262" and insert therefor -- 355/260 --.
"5,206,668" reference, please delete "346/6" and insert therefor -- 346/140R --.
"5,283,613" reference, please delete "399/9" and insert therefor -- 355/203 --.
"5,315,316" reference, please delete "347/3" and insert therefor -- 346/1.1 --.
"5,365,312" reference, please delete "399/12" and insert therefor -- 355/206 --.
"5,410,641" reference, please delete "358/1.13" and insert therefor -- 395/112 --.
"5,488,223" reference, please delete "235/375" and insert therefor -- 355/200 --.
"5,491,540" reference, please delete "399/12" and insert therefor -- 355/200 --.
"5,768,140" reference, please delete "700/225" and insert therefor -- 364/478.13 --.
"5,802,420" reference, please delete "399/27" and insert therefor -- 299/ --.
"5,812,156" reference, please delete "347/19" and insert therefor -- 347/ --.
"6,000,773" reference, please delete "347/7" and insert therefor -- 347/ --.
"6,010,210" reference, please delete "347/85" and insert therefor -- 347/ --.
"6,011,937" reference, please delete "399/24" and insert therefor -- 399/ --.
Please delete reference "6,312,106".
Please add the following U.S. PATENT DOCUMENT:
-- 5,917,508 06/1999 Lopez et al. 347/4 --
Please add the following FOREIGN PATENT DOCUMENTS:
-- EP 0 873 873 10/1998
EP 1 060 895 12/2000 --

Column 3,
Line 35, after "The" delete ".".

Column 9,
Lines 22-23, after "components" delete ".".

Column 13,
Line 51, delete "WFDS" and insert therefor -- IFDS --.

UNITED STATES PATENT AND TRADEMARK OFFICE

CERTIFICATE OF CORRECTION

PATENT NO. : 6,467,888 B2
DATED : October 22, 2002
INVENTOR(S) : Wheeler et al.

It is certified that error appears in the above-identified patent and that said Letters Patent is hereby corrected as shown below:

Column 15,
Line 28, delete “RFLD” and insert therefor -- RFID --.

Column 20,
Line 36, delete “by” and insert therefor -- be --.

Column 24,
Line 5, delete “replaceabl” and insert therefor -- replaceable --.

Signed and Sealed this

Ninth Day of March, 2004

JON W. DUDAS
*Acting Director of the United States Patent and Trademark Office*